US006253954B1

(12) United States Patent
Yasaka

(10) Patent No.: US 6,253,954 B1
(45) Date of Patent: Jul. 3, 2001

(54) ARTICLE STORAGE/DISPENSING DEVICE FOR VENDING MACHINE

(75) Inventor: Yoshio Yasaka, Gunma-ken (JP)

(73) Assignee: Sanyo Electric Co., Ltd., Osaka-fu (JP)

( * ) Notice: Subject to any disclaimer, the term of this patent is extended or adjusted under 35 U.S.C. 154(b) by 0 days.

(21) Appl. No.: 09/378,511

(22) Filed: Aug. 20, 1999

(51) Int. Cl.[7] ..... B65H 3/44
(52) U.S. Cl. ..... 221/93; 221/131
(58) Field of Search ..... 221/92, 93, 123, 221/131, 289, 107, 7, 13, 253; 211/59.2, 59.3

(56) References Cited

U.S. PATENT DOCUMENTS 2,632,681 * 3/1953 Newcomer ..... 221/93

* cited by examiner

*Primary Examiner*—Kenneth W. Noland
(74) *Attorney, Agent, or Firm*—Darby & Darby

(57) ABSTRACT

There is provided n article storage/dispensing device for a vending machine. Each article rack for storing articles has an article passage for storing the articles in a horizontal row, and a dispensing opening formed at one end of the article passage for dispensing the articles. Each article-dispensing mechanism is provided for the corresponding article rack in a manner movable between a dispensing position and a holding position. A single drive source causes each article-dispensing mechanism to move between the dispensing position and the holding position. Each linkage is capable of connecting the drive source to the corresponding article-dispensing mechanism and disconnecting the former from the latter, for causing the corresponding article-dispensing mechanism to move from the holding position to the dispensing position when the drive source is connected to the corresponding article-dispensing mechanism. Driving means actuates a linkage corresponding to an article selected by a purchaser, thereby connecting the drive source to an article-dispensing mechanism corresponding to the selected article, for vending the article.

11 Claims, 14 Drawing Sheets

ARTICLE STORAGE/DISPENSING DEVICE FOR VENDING MACHINE

BACKGROUND OF THE INVENTION

1. Field of the Invention

This invention relates to an article storage/dispensing device for a specific type of vending machine, such as a so-called see-through vending machine allowing articles actually contained therein to be viewed from a front of the machine, which stores lots of articles in horizontal rows, and dispenses the articles from a terminal position at one end or the other of each row for vending.

2. Prior Art

The present assignee proposed this kind of article storage/dispensing device e.g. in Japanese Patent Application No. 9-69210. The article storage/dispensing device is comprised of lots of shelves arranged one above another and secured to a body of a vending machine, a plurality of article racks placed on the respective shelves, and an elevator arranged at a location forward of the article racks such that it can move upward and downward for receiving an article from any of the article racks. The article racks each have an article passage formed therein for storing lots of articles in a manner horizontally placed one behind another, and an article-dispensing mechanism for dispensing an article from the article passage. The article-dispensing mechanism is comprised of a gate arranged in the vicinity of a dispensing opening (rack end opening) of the article passage, for opening/closing the dispensing opening through rotation thereof, and a pusher constantly urging the articles toward the dispensing opening by an urging force thereof.

Each of the article racks is provided with a drive mechanism, which is mounted on a portion of the machine body behind the article rack, for driving the gate for rotation. The drive mechanism is comprised of a motor, a gear mechanism for transmitting torque of the motor to the gate, and a plurality of limit switches for detecting an angle of rotation of the gate caused by rotation of the motor. The drive mechanism is operated to drive the motor in response to signals from the plurality of limit switches, whereby the gate is opened and closed.

In the article storage/dispensing device constructed as above, when the vending machine is in a standby state ready for vending articles, each gate is in its home position for holding a horizontal row of articles between the pusher and itself. During vending operation of the machine, first, the elevator moves to a predetermined position in the vicinity of the dispensing opening from which an article is to be dispensed, and stops thereat. Then, the drive mechanism is started to cause the gate to rotate from its home position through a predetermined angle to thereby open the dispensing opening. As a result, the horizontal row of articles in the article passage is advanced by the urging force of the pusher until a foremost one of the articles alone is dispensed forward from the dispensing opening. The dispensed article is received by the elevator and carried to a take-out opening located below the dispensing opening. After the article is dispensed, the motor of the drive mechanism performs reverse rotation, thereby causing the gate to rotate in a reverse direction to return to its home position. Thus, one vending cycle is completed.

According to the conventional article storage/ dispensing device described above, since each article rack needs a drive mechanism of its own, component parts and elements for use in the drive mechanism, such as a motor, a plurality of limit switches, cables connecting between the motor and the limit switches, are required to be provided according to the number of article racks arranged in the machine body. These component parts and elements are expensive, so that cost thereof is increased. At the same time, it is required to carry out wiring for connecting by cables between a motor and limit switches on a rack-by-rack basis, which increases assembly costs, resulting in an increase in manufacturing costs.

Further, in the conventional article storage/dispensing device, a horizontal row of articles within each article passage is pushed forward by a corresponding pusher for vending, so that the urging force of each pusher is set such that it exceeds a frictional force occurring between the bottom of a corresponding article passage and a maximum number of articles storable in the article passage. When the machine is in the standby state, a large urging force set as above constantly acts on articles in each article passage. As a result, if articles are contained in respective containers made of a soft material, they can be deformed or broken, which hinders the articles from being dispensed smoothly. Further, if articles stored in an article passage have a shape, such as one having a decreasing diameter toward the top or toward the bottom thereof, on which the urging force of the pusher cannot act evenly, the row of articles tend to get out of order when a foremost one of the articles is dispensed from the article passage. As a result, some or all of the articles can fall down one upon another or get caught by wells of the passage, which hinders smooth article dispensation.

SUMMARY OF THE INVENTION

It is a first object of the invention to provide an article storage/dispensing device for a type of vending machine which stores lots of articles in horizontal rows and dispenses each article from a terminal position at one end of each row, especially an article storage/dispensing device of this kind having a construction which makes it possible to decrease the number of component parts of a driving block, thereby reducing manufacturing costs.

It is a second object of the invention to provide an article storage/dispensing device for a type of vending machine which stores lots of articles in horizontal rows and dispenses the articles from a terminal position at one end of each row for vending, especially an article storage/dispensing device of this kind having a construction which enables reliable dispensation of the articles in a stable state.

To attain the first object, according to a first aspect of the invention, there is provided an article storage/dispensing device for a vending machine, comprising:

- a plurality of article racks each for storing a plurality of articles, each of the plurality of article racks having an article passage formed therein for storing the plurality of articles in a horizontal row, and a dispensing opening formed at one end of the article passage for dispensing the articles therefrom;
- a plurality of article-dispensing mechanisms each provided for one of the plurality of article racks corresponding thereto in a manner movable between a dispensing position for dispensing the articles from the dispensing opening and a holding position for holding the articles within the article passage;
- a single drive source for causing the plurality of article-dispensing mechanisms to move between the dispensing position and the holding position;
- a plurality of linkages each capable of connecting the drive source to one of the plurality of article-dispensing mechanisms corresponding thereto and disconnecting the drive source from the one of the plurality of article-dispensing mechanisms, for causing the one of the plurality of article-dispensing mechanisms to move from the holding position to the dispensing position when the drive source is connected to the one of the plurality of article-dispensing mechanisms; and driving means for selectively actuating one of the plurality of linkages which corresponds to an article selected by a purchaser, thereby connecting the drive source to one of the plurality of article-dispensing mechanisms which corresponds to the article selected by the purchaser, for vending the article selected by the purchaser.

According to this article storage/dispensing device for a vending machine, the driving means activates the linkage corresponding to the selected article for connection between the article-dispensing mechanism and the drive source, thereby causing the article-dispensing mechanism to dispense the selected article. That is, the article storage/dispensing device of the invention makes it possible to selectively drive any one of the plurality of article-dispensing mechanisms by the use of the single drive source to thereby selectively dispense a selected article from a correspond one of the plurality of article racks. As described above, differently from the prior art, the present invention requires not a plurality of drive sources but a single drive source for dispensing articles from the plurality of article racks, which contributes to reduction of costs of component parts and elements. Further, the plurality of article-dispensing mechanisms can be driven independently of each other, so that e.g. when all the article-dispensing mechanisms are selected, articles are dispensed from all the article racks.

Preferably, the drive source is a motor.

According to this preferred embodiment, it is possible to use a motor which is easily available and relatively compact in size, as a drive source. Further, since wiring is required only for the single motor, the number of cables and labor required for wiring can be reduced, which contributes to reduction of manufacturing costs.

More preferably, the motor is allowed to rotate in one direction, the plurality of linkages each including a reciprocating member which can be connected to or disconnected from the motor, the reciprocating member being driven for reciprocating motion interlocked with the rotation of the motor when the reciprocating member is connected to the motor, thereby causing the one of the plurality of article-dispensing mechanisms which corresponds to the article selected by the purchaser to reciprocate between the holding position and the dispensing position, and the driving means connecting the reciprocating member of the one of the plurality of linkages which corresponds to the article selected by the purchaser to the motor for vending the article selected by the purchaser.

According to this preferred embodiment, the motor does not perform normal and reverse rotations as in the prior art, but it rotates in one direction alone, so that service life of the motor is prolonged. Further, the motor can be operated simply by on-off driving, which facilitates control of the same. Moreover, when the driving means connects between the reciprocating member of the linkage corresponding to the selected article and the motor during the vending operation, the reciprocating member performs reciprocating motion in a manner interlocked with the rotation of the motor in one direction, whereby an article-dispensing mechanism corresponding to the selected article reciprocates between the holding position and the dispensing position to dispense the article. Thus, differently from the conventional device, the article storage/dispensing device of the invention is capable of dispensing an article without performing normal and reverse rotations, so that it is possible to dispense with not only limit switches each for detecting rotational angles caused by respective normal and reverse rotations of the motor, but also cables for electrically connecting between the respective limit switches and the motor, thereby reducing cost of components. In addition, since wiring for the limit switches is not required, assembly cost can be reduced.

Further preferably, each of the plurality of linkages further includes a gear mechanism, the gear mechanism comprising a first gear driven by the motor for rotation, and a second gear formed with gear teeth which can mesh with the first gear, and a cut-away portion formed by cutting away a portion of the gear teeth for inhibiting the second gear from engaging with the first gear via the cut-away portion, the reciprocating member being connected to the second gear such that the reciprocating member performs one cycle of reciprocating motion in accordance with one rotation of the second gear, and the driving means including second gear-driving means for normally positioning the second gear at a rotational angle position in which the cut-away portion is opposed to the first gear, and causing the second gear of the gear mechanism of the one of the plurality of linkages which corresponds to the article selected by the purchaser to rotate to a rotational angle position in which the gear teeth of the second gear are brought into meshing engagement with the first gear, for vending the article selected by the purchaser.

According to this preferred embodiment, during the vending operation, the second gear-driving means of the driving means causes the second gear of the linkage corresponding to the selected article to rotate to the rotational angle position in which the gear teeth of the second gear are brought into meshing engagement with the first gear, whereby the second gear is driven by the motor for rotation via the first gear. One rotation performed by the second gear causes one cycle of reciprocating motion of the reciprocating member, whereby the corresponding one of the article-dispensing mechanisms performs one cycle of reciprocating motion between the dispensing position and the holding position to thereby carry out one cycle of dispensing operation for dispensing the selected article. Thus, the mechanism for dispensing a selected article during the vending operation can be implemented by the components relatively simple in construction, i.e. the first gear and the second gear formed with the cut-away portion.

Preferably, the article storage/dispensing device further comprises an elevator arranged within a body of the vending machine at a location outward of the one end of the article passage of each of the plurality of article racks in a manner movable upward and downward, for stopping in a stop position close to the dispensing opening to receive the article selected by the purchaser, the driving means comprising a plurality of push rods provided in a manner corresponding to the plurality of article-dispensing mechanisms, respectively, and each extending in a front-rear direction between a vicinity of the dispensing opening and a vicinity of a corresponding one of the plurality of linkages, and urging means arranged in the elevator for urging one end of one of the plurality of push rods which corresponds to the article selected by the purchaser in the front-rear direction toward the corresponding one of the plurality of linkages when the elevator stops in the stop position, the corresponding one of the plurality of linkages being driven by engagement with another end of the one of the plurality of push rods which corresponds to the article selected by the purchaser, for connecting the drive source to the one of the plurality of article-dispensing mechanisms which corresponds to the article selected by the purchaser.

According to this preferred embodiment, during the vending operation, the urging means of the elevator stopping at the stop position urges the push rod corresponding to the selected article toward the corresponding linkage, thereby causing the linkage to connect the drive source to the article-dispensing mechanism corresponding to the selected article. As a result, the article-dispensing mechanism dispenses the selected article, and the elevator receives it. Thus, the driving means for driving a selected one of the plurality of linkages can be implemented by the components relatively simple in construction, i.e. the urging means and the plurality of push rods selectively urged by the urging means. Further, to actuate a selected linkage, it is only required to cause the urging means to urge the push rod. Therefore, it is possible to vend the article reliably by properly setting the area of the urging surface of the urging means to an area which is sufficiently large for urging the push rod even when the elevator stops at a location slightly deviated from the predetermined stop position.

Preferably, the article storage/dispensing device further comprises a shelf having the drive source and the plurality of linkages provided therefor, and the plurality of article racks placed thereon, and a plurality of mounting portions are arranged vertically within a body of the vending machine which accommodates the plurality of article racks, so as to allow the shelf to be selectively mounted to one of the plurality of mounting portions.

According to this preferred embodiment, it Is possible to shift a location within the machine body at which the shelf is mounted, without any need to adjust the positional relationship between the drive source, the plurality of linkages, and the plurality of article racks, which facilitates an operation for changing the height of a storage space above the shelf.

To attain the second object, according to a second aspect of the invention, there Is provided an article storage/dispensing device for a vending machine, comprising:

an article rack having two side walls opposed to each other, and a dispensing opening formed at one of front and rear ends thereof for dispensing articles therefrom;

a base plate arranged on a bottom of the article rack such that the base plate forms an article passage for storing a plurality of articles in a row extending in a front-rear direction, together with the two side walls, and such that the base plate is capable of moving in the front-rear direction relative to the article rack between a dispensing position in which the base plate is projected outward from the dispensing opening of the article rack and a standby position in which the base plate is retracted inward;

a stopper arranged on a top surface of the base plate;

first engaging means for holding the stopper in engagement with the base plate during movement of the base plate toward the dispensing position;

second engaging means for holding the stopper in engagement with the article rack during movement of the base plate toward the standby position; and a drive mechanism for holding the base plate in the standby position when the vending machine is in a standby state ready for vending the articles, and causing the base plate to move to the dispensing position, and then move back to the standby position, during operation of the vending machine for vending the articles.

According to this article storage/dispensing device for a vending machine, when the base plate moves from the standby position to the dispensing position during the vending operation, the stopper is held in engagement with the base plate by the first engaging means, so that the plurality of articles within the article passage are held on the base plate arranged on the bottom of the article rack and in contact with the stopper which prevents the articles from falling down in a direction opposite to the direction of movement of the base plate, and move together with the base plate with their attitudes fixed by the stopper. Subsequently, when the base plate moves back toward the standby position after having reached the dispensing position, the stopper is engaged with the article rack by the second engaging means, and independent of the motion of the base plate. Thus, the articles stored in the article passage are inhibited from moving rearward by the stopper held in engagement with the article rack, independently of the rearward movement of the base plate. As a result, one of the articles projecting outward from the dispensing opening is dispensed downward therefrom.

As described above, the articles are carried to the dispensing position during the vending operation in a state held on the base plate and with their attitudes fixed by the stopper, so that even if the articles are each contained in a container made of a soft material, or each have a shape on which the urging force cannot act evenly, differently from the prior art, the horizontal row of the articles is prevented from getting out of order, which makes it possible to carry the articles to the dispensing position in a stable state and dispense the same smoothly. Further, the article storage/dispensing device according to the second aspect of the invention is different from the conventional one in that the urging force of the stopper does not act on the articles except when one of the articles is dispensed for vending, and the urging force acting on the articles in the article passage is progressively reduced as the number of the remaining articles decreases through vending. Therefore, even articles each contained in a container made of a soft material can be stored in the article passage and dispensed for vending, without being deformed or broken, differently from the prior art.

Preferably, the article storage/dispensing device further comprises adjustment means for adjusting a stroke over which the base plate moves between the standby position and the dispensing position.

According to this preferred embodiment, it is possible to adjust the stroke of the base plate according to the depth of each article. Accordingly, if the stroke is set to a value which is approximately equal to the depth of each article in the article passage, an article located most outward from the dispensing opening at the time point that the base plate is about to move back toward the standby position after having reached the dispensing position is dispensed downward substantially in an attitude-fixed manner at the moment that the base plate moves off the whole bottom of the article. Thus, the articles in the article passage can be dispensed downward more reliably in a stable state.

More preferably, the adjustment means comprises a base plate stopper which is selectively mounted to one of a plurality of mounting positions fixed with respect to the article rack and arranged in the front-rear direction, such that the base plate is brought into abutment with the base plate stopper when the base plate has moved to the dispensing position.

According to this preferred embodiment, since the base plate stopper is immovably mounted or set with respect to the article rack, the base plate abuts against the base plate stopper when it has moved to the dispensing position, whereby the base plate is positively inhibited from further advancing. This base plate stopper can be selectively mounted at any one of a plurality of mounting positions arranged in the horizontal direction, so that it is possible to change the stroke of the base plate between the standby position and the dispensing position, as required, according to the depth of each article to be dispensed.

Preferably, the article storage/dispensing device further comprises a gate for closing the dispensing opening to thereby hold the plurality of articles between the stopper and itself when the vending machine is in the standby state ready for vending the articles, and opening the dispensing opening during the vending operation of the vending machine for vending the articles.

According to this preferred embodiment, since the gate holds the dispensing opening in a closed state when the machine is in a standby state for vending the articles, the articles in the article passage are held between the gate and the stopper to be prevented from being erroneously dispensed from the dispensing opening. During the vending operation, since the gate opens the dispensing opening, it is possible to dispense the articles for vending, as described above. Thus, reliable vending is ensured.

Preferably, the base plate is formed with a first rack gear extending in the front-rear direction, while the article rack is formed with a second rack gear extending in the front-rear direction, the first engaging means comprising a first pinion gear in meshing engagement with the first rack gear formed on the base plate, and a first blocking member for inhibiting rotation of the first pinion gear during movement of the base plate toward the dispensing position, and the second engaging means comprising a second pinion gear in meshing engagement with the second rack gear formed on the article rack, and a second blocking member for inhibiting rotation of the second pinion gear during movement of the base plate toward the standby position.

According to this preferred embodiment, the mechanism for positively holding the stopper in engagement with the base plate during the movement of the base plate toward the dispensing position, and in engagement with the article rack during the movement of the base plate toward the standby position can be implemented by the rack gears respectively formed on the base plate and the article rack and the pair of pinion gears and the blocking member provided in the stopper, which are relatively easy to manufacture and relatively simple in construction. Thus, the mechanism for dispensing articles reliably and stably as described above can be realized at low costs.

The above and other objects, features, and advantages of the invention will become more apparent from the following detailed description taken in conjunction with the accompanying drawings.

BRIEF DESCRIPTION OF THE DRAWINGS

FIGS. 8A to 8C are views schematically showing operations of the article-dispensing mechanism, in which:

FIG. 8A shows the article-dispensing mechanism in a state of a base plate being held in a holding position;

FIG. 8B shows the article-dispensing mechanism in a state of the base plate having moved to a dispensing position; and FIG. 8C shows the article-dispensing mechanism in a state of the base plate having returned to the holding position;

DETAILED DESCRIPTION

Figure 1:
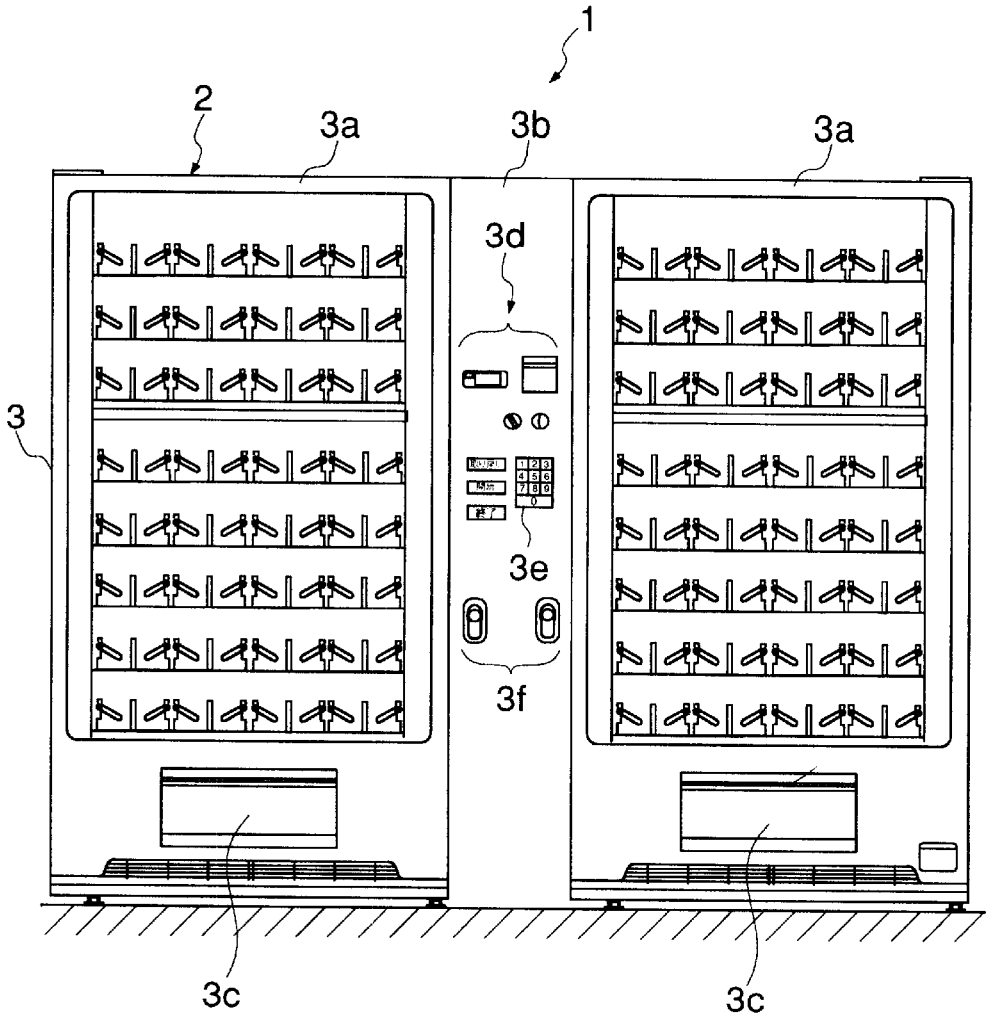
FIG. 1 is a front view of a vending machine incorporating an article storage/dispensing device according to an embodiment of the invention.

The invention will now be described in detail with reference to drawings showing an embodiment thereof.

First, the outline of the construction and operations of an article storage/dispensing device according to the embodiment will be described, and detailed description of component parts and elements thereof will be made thereafter.

As shown in FIGS. 1 to 8C, the article storage/ dispensing device 1 has thirty-two article racks 4 arranged for each vending unit within a machine body 3 of a vending machine 2. The racks 4 are in eight vertical layers and four horizontal rows. Each of the article racks 4 is formed with a pair of right and left article passages 4*f*, 4*f* extending in parallel with each other in a front-rear direction, and provided with a pair of article-dispensing mechanisms 10, 10 for dispensing articles S from the right and left article passages 4*f*, 4*f*, respectively. Each four article racks 4 arranged in a row are placed on a shelf 6 mounted in a storage box 5 within the machine body 3, such that each of the racks 4 extends horizontally in the front-rear direction. Further, arranged on the shelf 6 is a drive mechanism 20.

Figure 3:
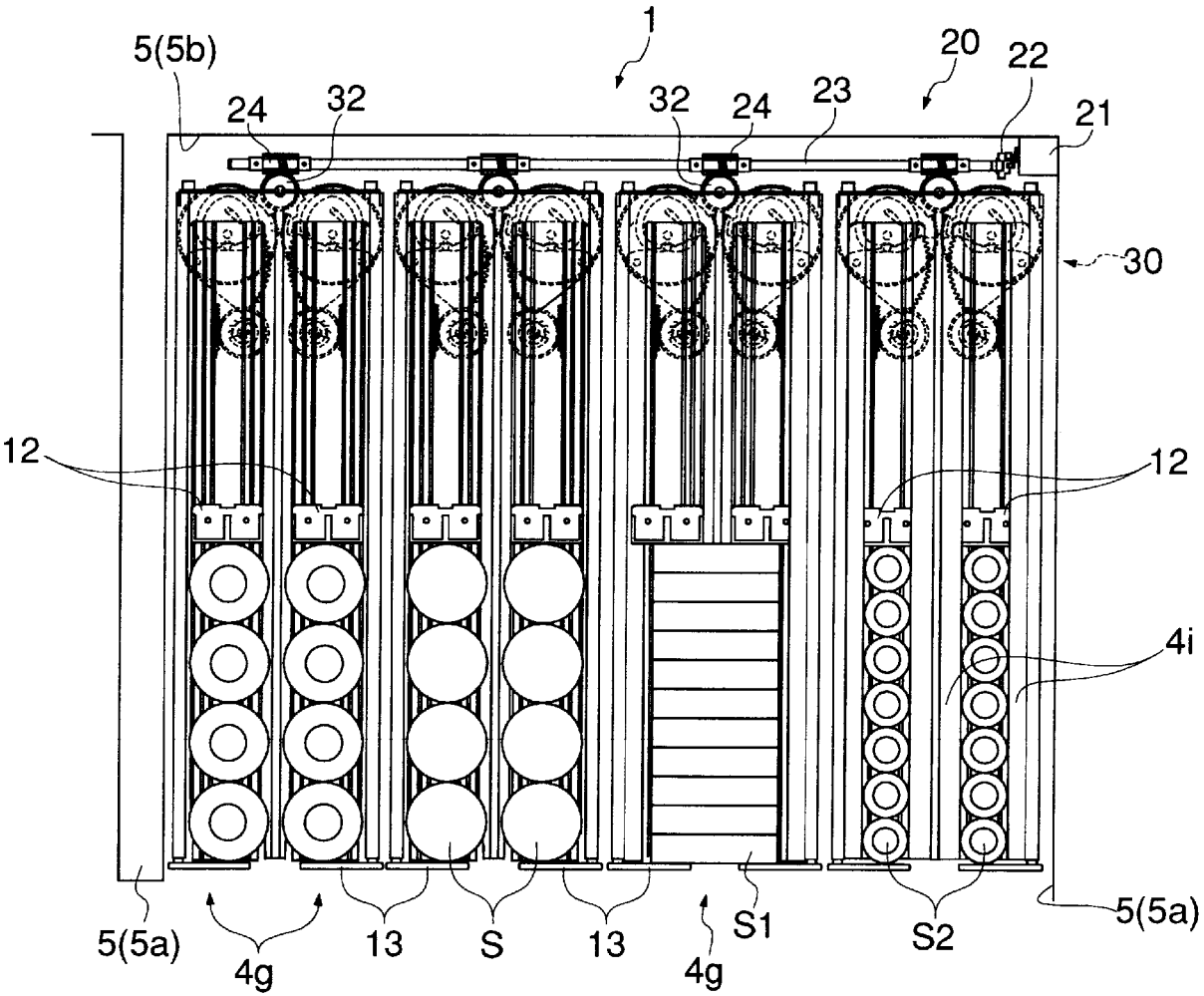
FIG. 3 is a plan view showing article racks and drive mechanisms within the storage box.
Figure 8A:
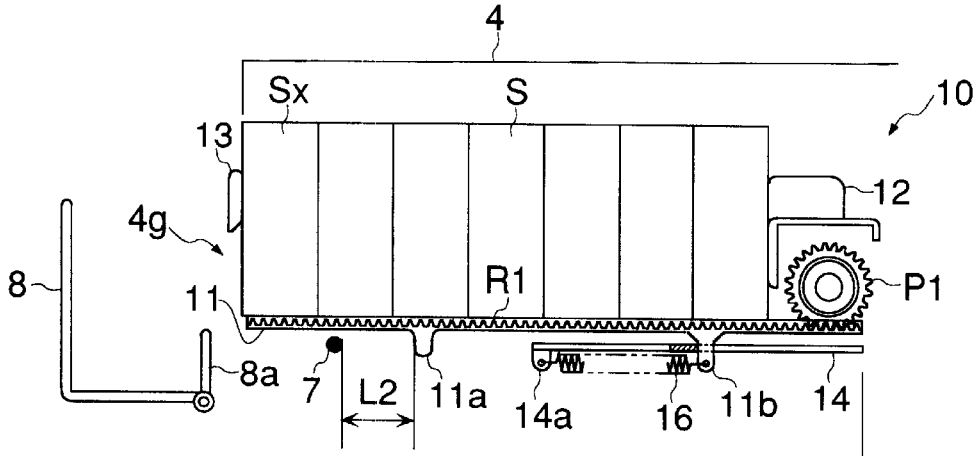
Figure 8B:
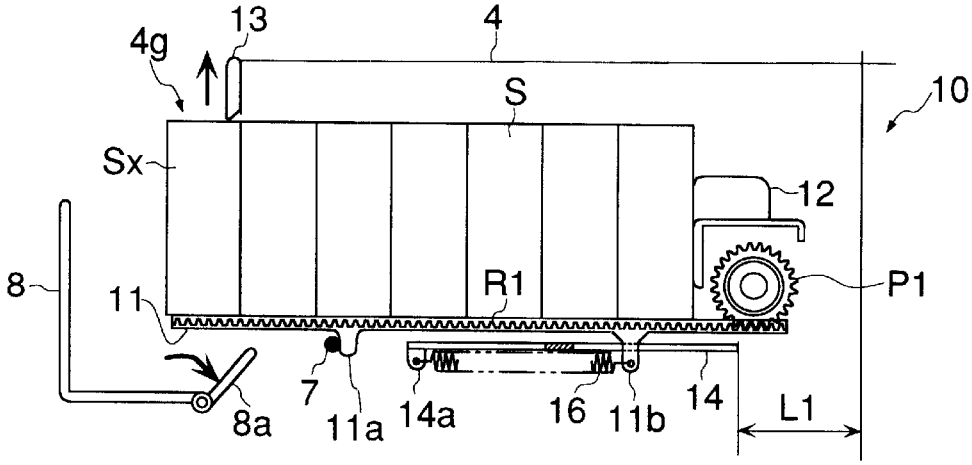
Figure 8C:
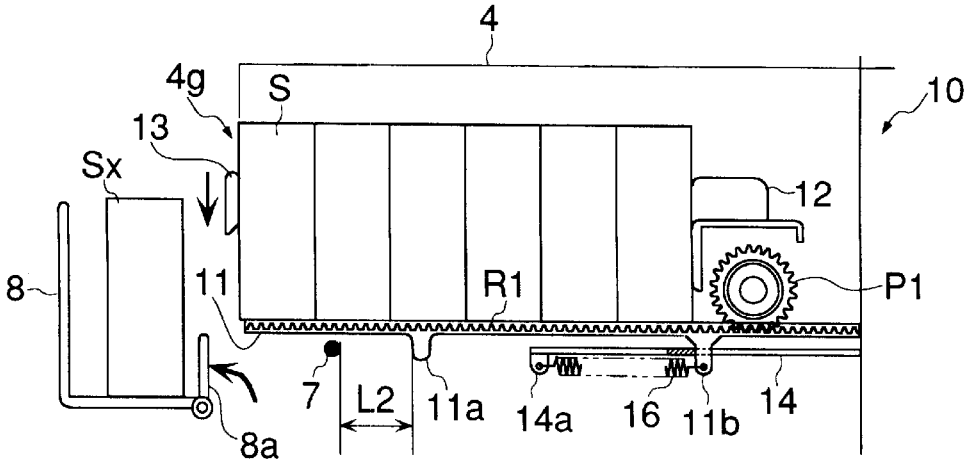
Figure 10:
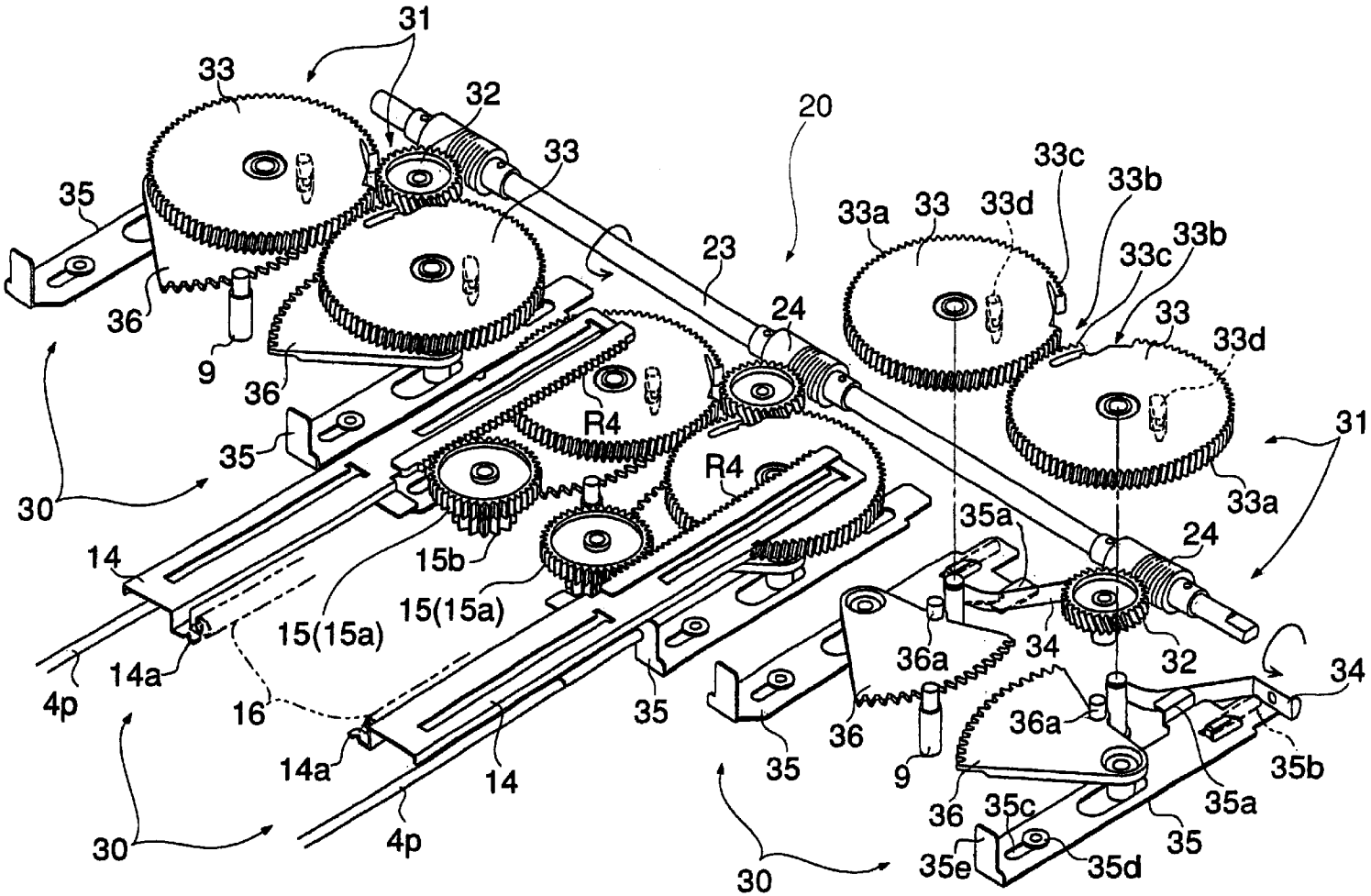
FIG. 10 is a perspective view showing the construction of linkages.

As shown in FIGS. 3 and 10, the drive mechanism 20 is comprised of a single motor 21 and linkages 30 provided for the respective article-dispensing mechanisms 10 in each of the article racks 4. Each of the linkages 30 and the motor 21 are linked to each other via a reduction gear mechanism 22 and a drive shaft 23. The linkage 30 can be switched between a connected state (shown in FIGS. 12 to 14) for connecting the motor 21 to a corresponding one of the article-dispensing mechanisms 10 and a disconnected state (shown in FIG. 11) for disconnecting the motor 21 from the article-dispensing mechanism 10. When the vending machine is in a standby state ready for vending articles, the linkage 30 is held in the disconnected state. Each of the article racks 4 is provided with a pair of push rods 4*p* for switching the corresponding linkage 30 from the disconnected state to the connected state. As shown in FIGS. 8A to 8C, in the machine body 3, there are provided an elevator 8 for receiving an article S dispensed by an article-dispensing mechanism 10 and carrying the same for vending. The elevator 8 has solenoid mechanisms, not shown, each for urging a push rod 4*p* associated therewith when excited, to thereby switch the corresponding linkage 30 from the disconnected state to the connected state.

In the article storage/dispensing device 1 constructed as above, when one of buttons or keys of a product selection keypad 3*e* is pushed by a purchaser for selection of an article S, the vending operation of the vending machine 2 is started. First, the elevator 8 moves to the vicinity of the dispensing opening 4*g* of the article passage 4*f* in which the selected article S is stored, and stops thereat as shown in FIG. 8A. Then, the solenoid mechanism is excited to urge a push rod 4*p* corresponding to the article passage 4*f*, whereby a corresponding linkage 30 is switched from the disconnected state to the connected state. This switching causes the linkage 30 to connect between the motor 21 and an article-dispensing mechanism 10 associated with the article passage 4*f*, and torque of the motor 21 enables the mechanism 10 to carry out operation for dispensing the article S. Thus, the selected article S is dispensed from the article passage 4*f*.

Next, detailed description will be made of the article storage/dispensing device 1 according to the present embodiment.

Referring first to FIG. 1, the vending machine 2 is a so-called see-through vending machine which allows articles S (see FIGS. 2 and 3) actually stored therein to be viewed from the front of the machine. The vending machine 2 includes a machine body 3 of showcase type comprised of a pair of vending units connected in a left-right direction. The machine body 3 has a pair of main doors 3*a*, 3*a*, and a control panel 3*b* flush with the main doors 3*a*, 3*a*. Each main door 3*a* is hinged at an outer side thereof, and has a take-out opening 3*c* formed in a lower portion thereof and a transparent window for allowing the articles S to be viewed from outside. The control panel 3*b* is arranged in a central portion of the front face of the machine body 3 between the two main doors 3*a*, 3*a*. The control panel 3*b* includes two slots 3*d* for receiving coins and bills, the product selection keypad 3*e* of ten-key type, and a pair of locks 3*f*, 3*f* for locking/unlocking the respective main doors 3*a*, 3*a*.

Figure 2:
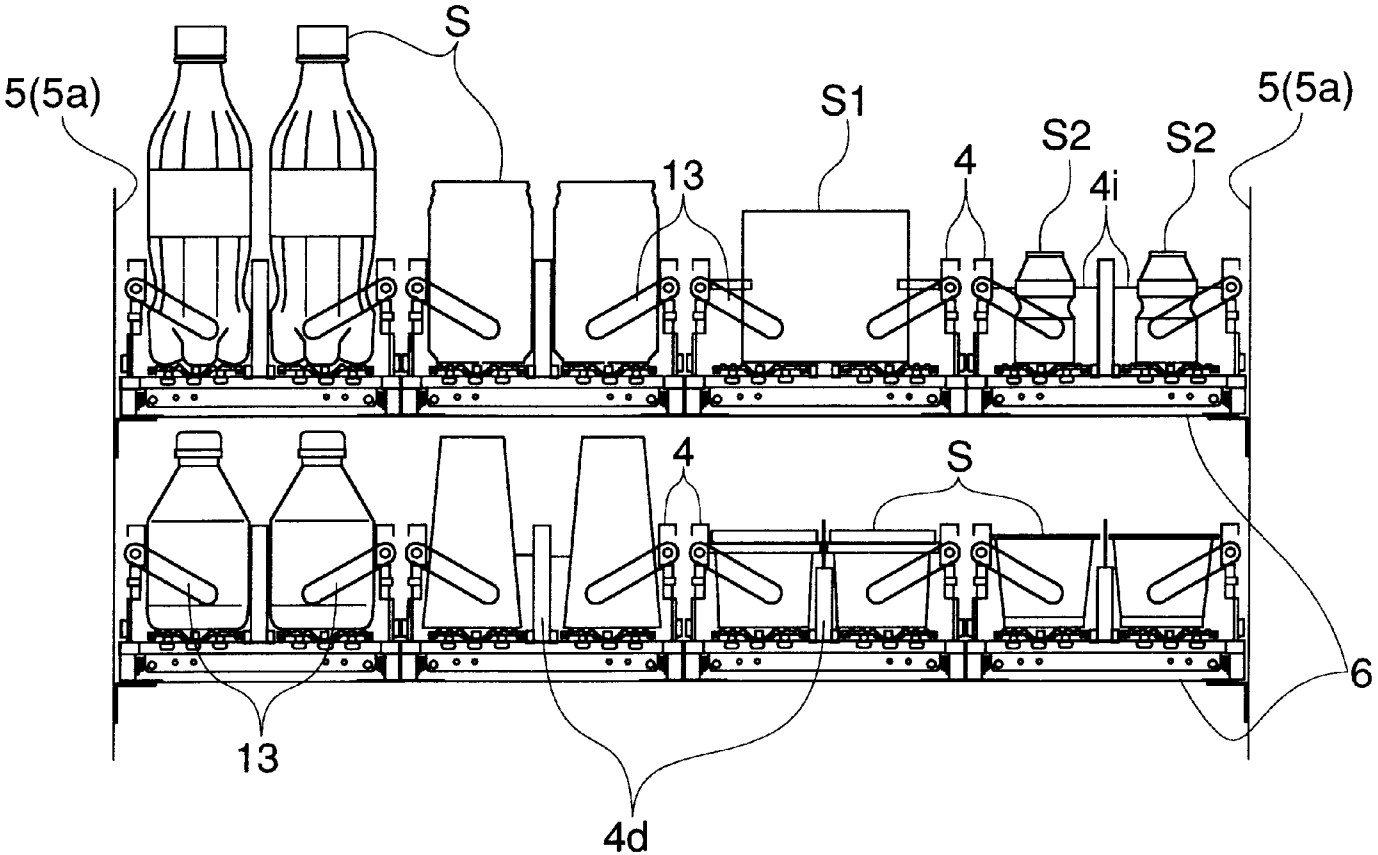
FIG. 2 is a front view of article racks received in a storage box of the FIG. 1 vending machine.

As shown in FIGS. 1 to 3, mounted in each of the storage boxes 5, 5 within the machine body 3 are a total of thirty-two article racks 4 which are arranged in eight vertical layers and four horizontal rows. Each article rack 4 has a number plate indicative of a rack number, not shown, which is attached to a front end face of the article rack at a location permitting the rack number to be viewed through the window. A purchaser views articles S in the racks 4 for selection of an article S to be purchased, and then enters the rack number shown on the number plate corresponding to an article rack 4 containing the selected article S, by using the selection keypad 3*e*, thereby purchasing the desired article S.

Figure 9A:
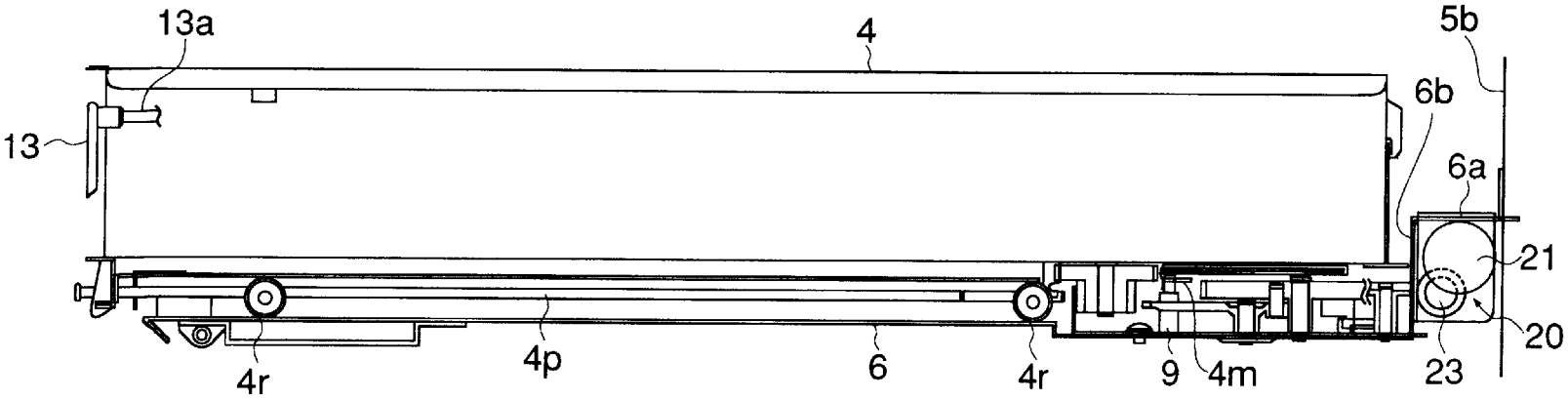
FIG. 9A is a side view of the article rack in a state in which it is in a received position on a shelf.
Figure 9B:
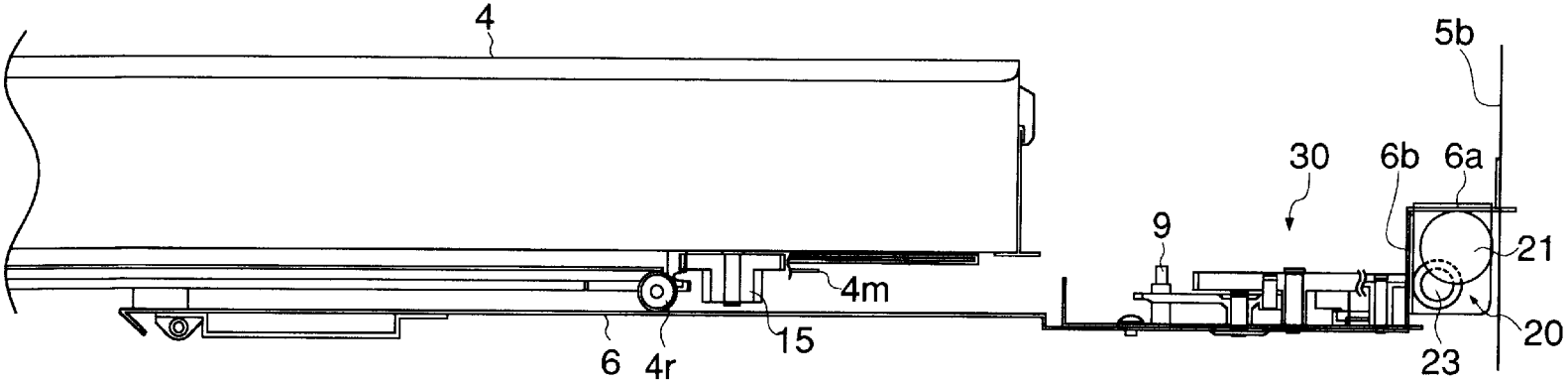
FIG. 9B is a side view of the article rack in a state in which it is drawn out of the received position e.g. for loading.

Each layer of article racks 4 (four racks arranged side by side) are placed on a single shelf 6. The shelves 6 are each secured to left and right side walls 5*a*, 5*a* of the storage box 5 and a rear wall 5*b* of the same in a horizontal position. The left and right side walls 5*a*, 5*a* and the rear wall 5*b* are each formed with a plurality of mounting holes (mounting portions), not shown, arranged vertically. Each of the shelves 6 has left and right end thereof formed with respective left and right plug portions, not shown, which are fitted in selected ones of the mounting holes in the left and right side walls 5*a*, 5*a* of the storage box 5, respectively. Further, as shown in FIGS. 9A, 9B, the shelves 6 each have a rear wall 6*b* formed by bending a rear end portion thereof substantially vertically upward, and a mounting portion 6*a* formed by bending a top end portion of the rear wall 6*b* rearward at right angles. The mounting portion 6*a* is fitted in a selected one of the mounting holes formed in the rear wall 5*b* of the storage box 5. A location within the storage box 5 at which each of the shelves 6 is mounted can be shifted vertically by selectively fitting the plug portions and mounting portion 6*a* of the shelf 6 in desired ones of the mounting holes of the storage box 5.

Figure 4:
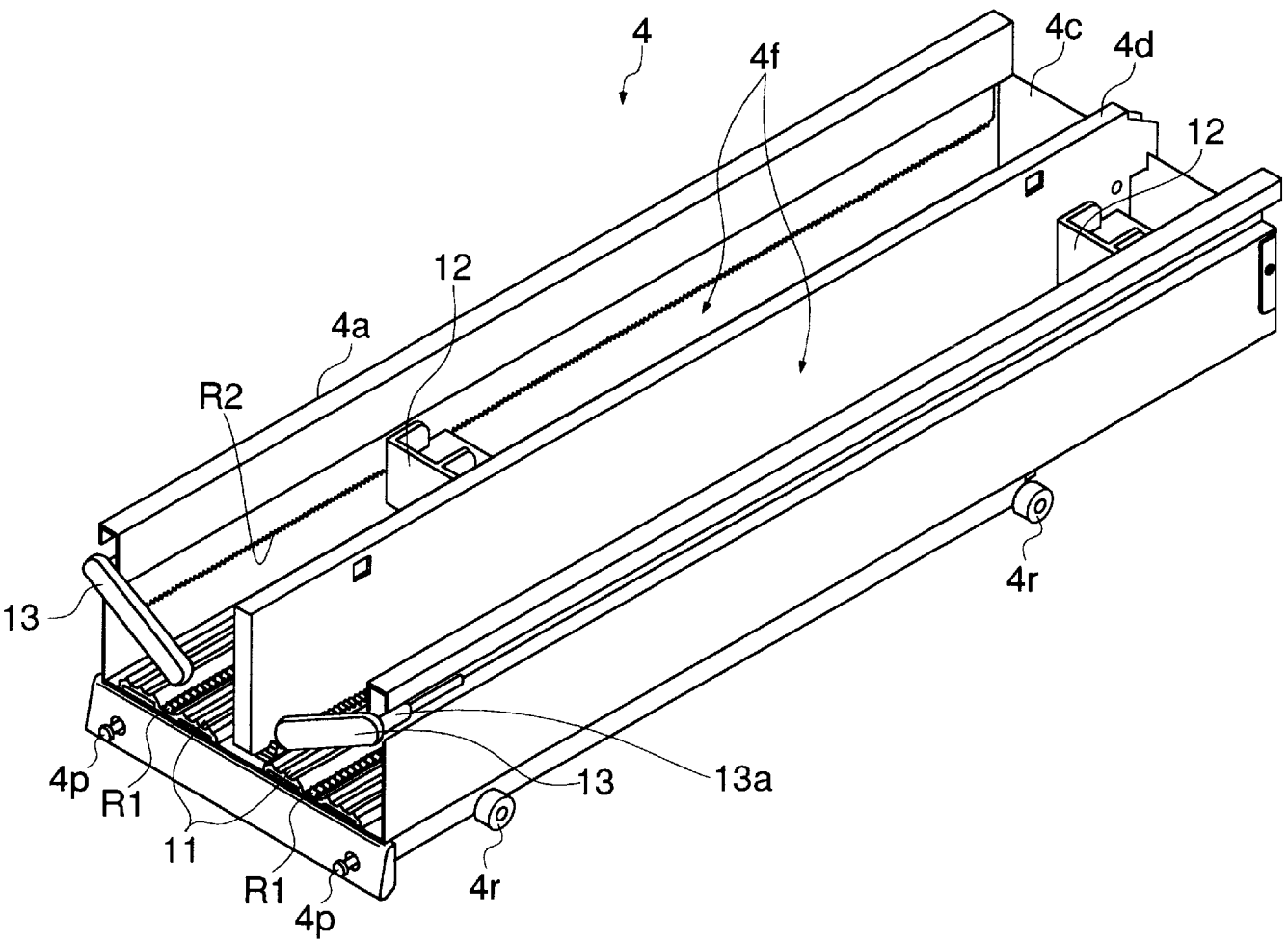
FIG. 4 is a perspective view of an article rack.
Figure 5:
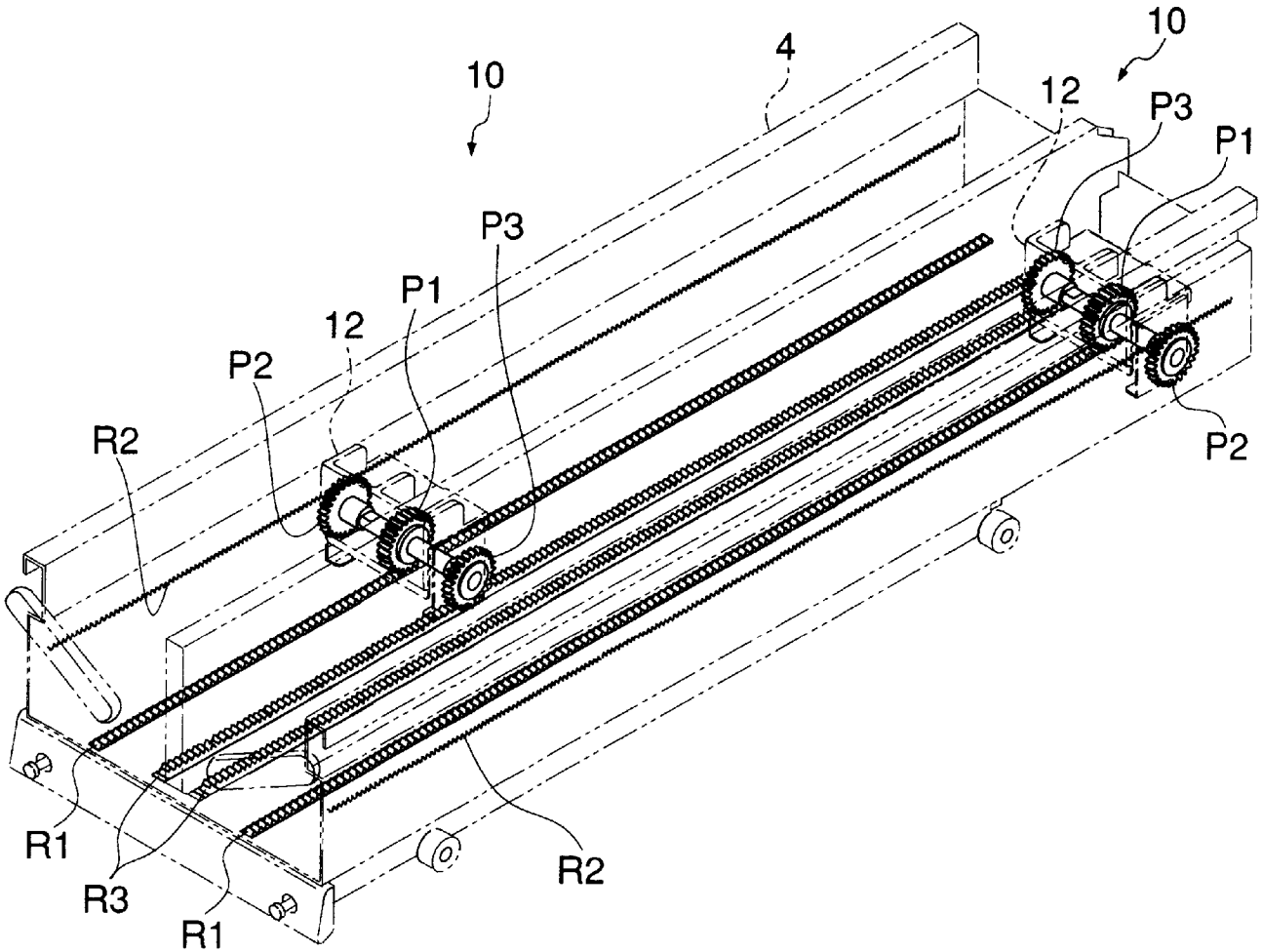
FIG. 5 is a perspective view showing the positional relationship between pinion gears and respective rack gears corresponding thereto.
Figure 6:
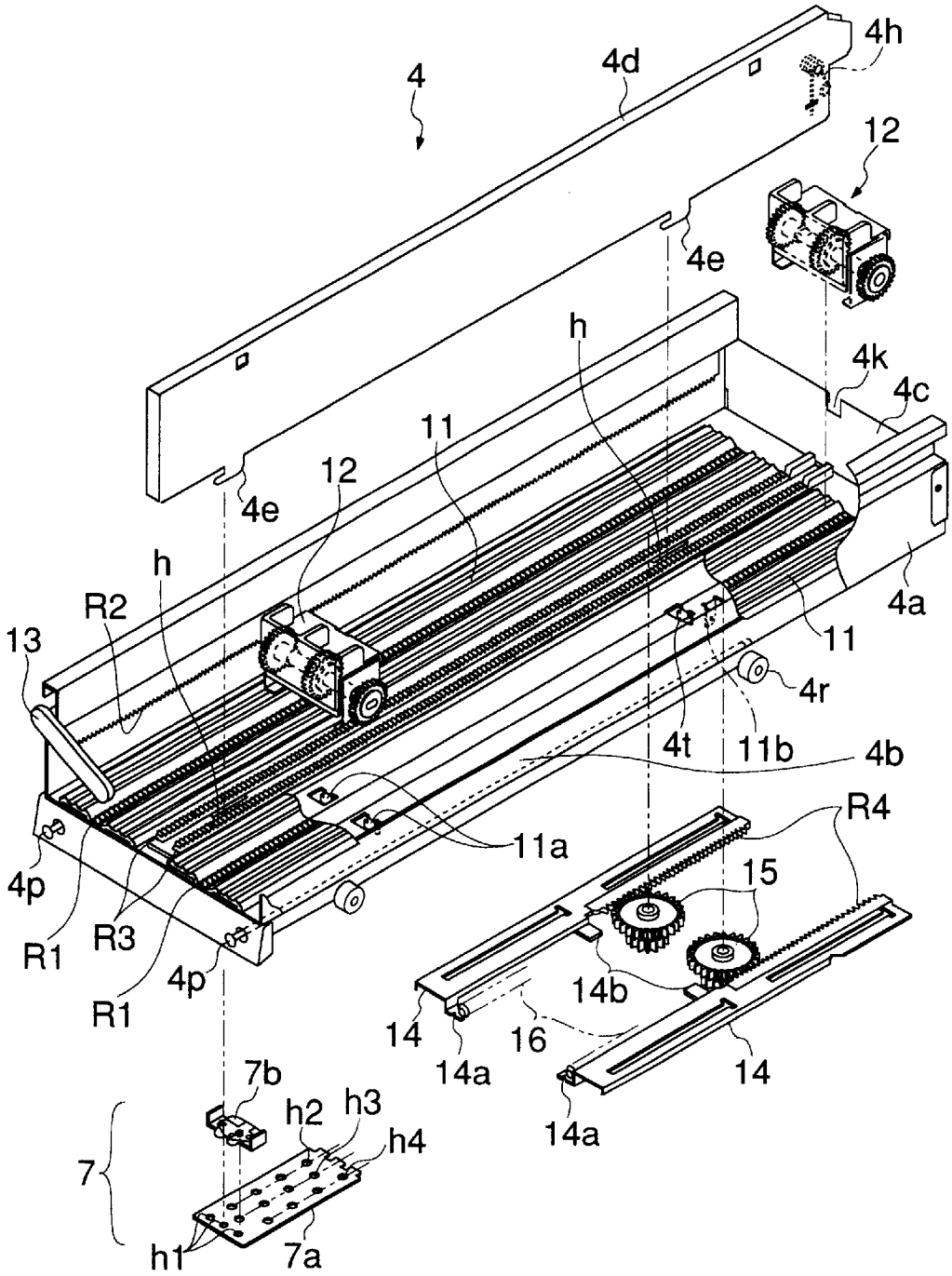
FIG. 6 is an exploded perspective view showing an article-dispensing mechanism and a portion of the article rack associated therewith.

As shown in FIGS. 4 to 6, each of the article racks 4 has two side walls 4*a*, 4*a* opposed to each other, a bottom wall 4*b*, and a rear wall 4*c*. A partition wall 4*d* is removably mounted on the bottom wall 4*b* in a manner extending along a center line of the same. The partition wall 4*d* is formed with two claws 4*e*, 4*e* projecting downward from a lower end thereof, while the bottom wall 4*d* is formed with two slits h, h for engagement with the two claws 4*e*, 4*e*. Further, imbedded in a rear end portion of the partition wall 4*d* is a torsion coiled spring 4*h*, and a cut-away portion 4*k* is formed at an upper end portion of the rear wall 4*c*.

In mounting the partition wall 4*d* in the article rack 4, the claws 4*e*, 4*e* are each fitted in a corresponding one of the slits h, h, and at the same time, the rear end of the partition wall 4*d* is fitted in the cut-away portion 4*k*. At this time point, the torsion coiled spring 4*h* abuts against an inner surface of the rear wall 4*c* in a compressed state, to push the partition wall 4*d* forward by its urging force, whereby the claws 4*e*, 4*e* are brought into engagement with the slits h, h, respectively, to secure the partition wall 4*d* to the article rack 4. On the other hand, in removing the partition wall 4*d* from the article rack 4, the partition wall 4*d* is pushed rearward against the urging force of the torsion coiled spring 4*h* for disengagement of the claws 4*e*, 4*e* from the respective slits h, h. When the partition wall 4*d* is removed from the article rack 4, it is possible to store articles S having a relatively large width, such as articles S1 in a second rack from the right in FIG. 3. Further, the article rack 4 is provided with adapters 4*i* which can be removably mounted to the side walls 4*a* and the partition wall 4*d*, respectively, to thereby restrict the width of the article passage 4*f* between each of the side walls 4*a* and the partition wall 4*d*. This allows storage of articles S having a small width, such as articles S2 in the article passage 4*f* in a right end rack in FIG. 3.

Further, as shown in FIGS. 5 and 6, the bottom wall 4*b* has a pair of third rack gears R3, R3 formed on a top surface thereof at respective locations symmetric with respect to the partition wall 4*d*. The third rack gears R3. R3 extend in the front-rear direction alongside the partition wall 4*d*. On the other hand, each of the side walls 4*a*, 4*a* has a second rack gear R2 formed on a upper portion of an inner surface thereof. The pair of second rack gears R2, R2 each having a tooth surface facing downward are formed at respective locations symmetric with respect to the partition wall 4*d* and extend in the front-rear direction similarly to the third rack gears R3, R3.

Each of the article racks 4 is provided with a pair of left and right article-dispensing mechanisms 10, 10 for dispensing articles S stored in the rack 4. The left and right article-dispensing mechanisms 10, 10 are generally symmetrical in construction with respect to the partition wall 4*d*, so that description will be made of only the mechanism 10 on the right-hand side as viewed in FIGS. 4 to 6. The right-hand article-dispensing mechanism 10 is comprised of a base plate 11, a stopper 12 arranged on the base plate 11, and a gate 13 mounted at a front end of the article rack 4. The base plate 11 is placed on the bottom wall 4*b*, and forms the article passage 4*f* for storing articles S, together with the side wall 4*a* and the partition wall 4*d*. As shown in FIGS. 8A to 8C, the base plate 11 is movably arranged on the bottom wall 4*b* in the front-rear direction for reciprocation between a dispensing position in which a forward end of the base plate 11 projects outward from the dispensing opening 4*g* and a holding position (standby position) in which the forward end face of the base plate 11 is flush with the dispensing opening 4*g*. A stroke L2 of the base plate 11 between the dispensing position and the holding position determines an amount of projection of the forward end of the base plate 11 from the dispensing opening 4*g* when the base plate 11 is in the dispensing position.

As shown in FIGS. 5 and 6, along a center line of a top surface of the base plate 11, there is formed a first rack gear R1 extending in parallel with the rack gears R2, R3. The base plate 11 also has a pair of projections 11*a*, 11*a* formed by cutting and bending portions of the base plate 11 at respective locations symmetric with respect to the center line thereof in a manner projecting downward. The projections 11*a*, 11*a* are brought into abutment with a base plate stopper 7 when the base plate 11 reaches the dispensing position.

As shown in FIG. 6, the base plate stopper 7 is comprised of a mounting plate 7*a* screwed onto the bottom wall 4*b* of the article rack 4 and an abutment member 7*b* mounted on the mounting plate 7*a*. The projections 11*a* are brought into abutment with a rear end of the abutment member 7*b*. The mounting plate 7*a* has a front end portion thereof formed with three mounting holes h1 arranged in the left-right direction, and is screwed onto the bottom wall 4*b* of the article rack 4 via the mounting holes h1. Further, the mounting plate 7*a* is formed with four round hole groups each including three round holes h2 to h4. The four round hole groups are arranged rearward of the mounting holes h1, one behind another, in the front-rear direction. On the other hand, the abutment member 7*b* is formed with three projections, not shown, for being fitted in a selected group of round holes h2 to h4.

Accordingly, the abutment member 7*b* can be slid in the front-rear direction in a state sandwiched between the mounting plate 7*a* and the bottom wall 4*b*, whereby it is possible to select a group of round holes h2 to h4 for engagement with the three projections of the abutment member 7*b*, to set a mounting position of the abutment member 7*b* on the mounting plate 7*a*, i.e. on the article rack 4, to a desired one of four predetermined locations. Thus, the stroke (projection amount) L2 of the base plate 11 over which the bare plate 11 moves before the projections 11*a* thereof abut against the abutment member 7*b* can be selectively set to a desired one of four levels between a maximum stroke L2max and a minimum stroke L2min, which makes it possible to change or adjust the stroke L2 of the base plate 11 appropriately according to the depth of each article stored. In the present embodiment, the stroke L2 is set to a value which is approximately equal to the depth of each article S. On a back surface of the abutment member 7*b*, there is mounted an elastic body (e.g. synthetic rubber), not shown, for absorbing shock caused by abutment of the projections 11*a* against the abutment member 7*b*.

Figure 7:
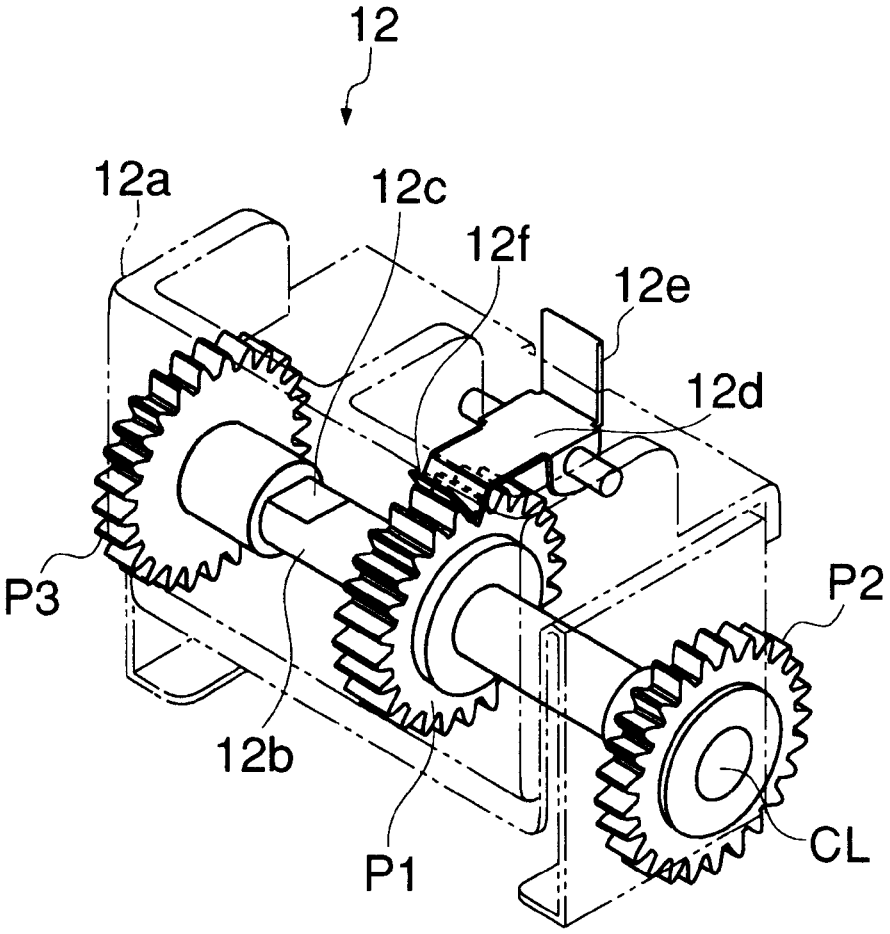
FIG. 7 is a perspective view of a stopper.

As shown in FIG. 7, the stopper 12 is comprised of a box-like stopper body 12*a*, a rotational shaft 12*b* mounted in the stopper body 12*a* in a manner extending in the left-right direction, and three pinion gears P1 to P3 fitted on the rotational shaft 12*b*, for constant meshing engagement with the respective first to third rack gears R1 to R3. The stopper body 12*a* has a front wall thereof spreading perpendicularly with respect to the base plate 11 and held in contact with a rearmost one of the articles S stored in the article passage 4*f*.

The first pinion gear P1 is clearance fitted on a central portion of the rotational shaft 12*b* such that the gear P1 can rotate about the rotational shaft 12*b*. Mounted on the stopper body 12*a* is a lever (first blocking member) 12*d* for inhibiting clockwise rotation (as viewed in FIG. 7) of the first pinion gear P1. The lever 12*d* has a central portion thereof pivotally supported on the stopper body 12*a*, and a front end thereof formed with a claw 12*f* which is normally engaged with the first pinion gear P1 for inhibiting the clockwise rotation of the first pinion gear P1 and allowing only counterclockwise rotation of the same. Further, the lever 12*d* has a rear end portion thereof formed as a knob 12*e* extending upward. When the knob 12*e* is pushed rearward, the lever 12*d* rotates clockwise to disengage the claw 12*f* from the first pinion gear P1, whereby the pinion gear P1 is allowed to perform clockwise rotation.

The second pinion gear P2 is mounted on a right-side end portion of the rotational shaft 12*b* via a one-way clutch (second blocking member) CL. The second pinion gear P2 is inhibited by action of the one-way clutch CL from rotating counterclockwise about the rotational shaft 12*b*. Further, the pinion gear P3 is mounted on a left-side end portion of the rotational shaft 12*b*, as viewed in FIG. 7, which has a flat cut-away portion 12*c* formed thereon. Normally, the pinion gear P3 is drivably fitted on the left end of the rotational shaft 12*b*, for rotation in unison with the rotational shaft 12*b*. The pinion gear P3 is connected to the lever 12*d* by a linkage, not shown, which causes the pinion gear P3 to move leftward along the rotational shaft 12*b* when the lever 12*d* is rotated clockwise, for disengagement from the left end of the rotational shaft 12*b*.

As shown in FIGS. 5 and 6, the second and third rack gears R2, R3 in meshing engagement with the respective second and third pinion gears P2, P3 are arranged on an upper side of the gear P2 and on a lower side of the gear P3, respectively, so that the gear P2 and the gear P3 rotate in different directions when the stopper 12 moves in the front-rear direction. Further, the second pinion gear P2 mounted on the rotational shaft 12*b* via the one-way clutch CL is allowed by the action of the one-way clutch CL to rotate in accordance with motion of the stopper 12 only when the gear P2 rotates clockwise and the third pinion gear P3 and the rotational shaft 12*b* rotate counterclockwise.

In the stopper 12 constructed as above, when the base plate 11 moves toward the dispensing position, as shown in FIG. 8B, to dispense an article S for vending, the first pinion gear P1 is inhibited by the lever 12*d* from rotating clockwise, so that the gear P1 is held in engagement with the first rack gear R1 without rotation. The second pinion gear P2 is allowed by the one-way clutch CL to perform clockwise rotation about the rotational shaft 12*b* in meshing engagement with the second rack gear R2. The third pinion gear P3 fitted on the left end of the rotational shaft 12*b* formed with the cut-away portion 12*c* performs counterclockwise rotation in unison with the rotational shaft 12*b*, in meshing engagement with the third rack gear R3. The first pinion gear P1 is loosely fitted on the rotational shaft 12*b*, and hence it cannot interfere with the counterclockwise rotation of the rotational shaft 12*b*. As described above, when the base plate 11 moves toward the dispensing position, the first pinion gear P1 is inhibited from rotating, in a state held in engagement with the first rack gear R1 on the base plate 11, while rotation of the rotational shaft 12*b* is not inhibited by the gear P1 loosely fitted thereon. As a result, the stopper 12 moves toward the dispensing position together with the base plate 11 in a state held on the same.

When the base plate 11 moves back toward the holding position after having reached the dispensing position, as shown in FIG. 8C, the first pinion gear P1 performs counterclockwise rotation in meshing engagement with the first rack gear R1 on the base plate 11. The second pinion gear P2 is inhibited by the one-way clutch CL from rotating counterclockwise about the rotational shaft 12*b*, so that the gear P2 is held in engagement with the second rack gear R2 without rotation. Since the rotational shaft 12*b* is not allowed to perform rotation with respect to the second pinion gear P2, the third pinion gear is also inhibited from rotating, in a state held in engagement with the third rack gear R3. Thus, the second and third pinion gears P2, P3 are held in engagement with the respective second and third rack gears R2, R3 of the article rack 4 without rotation, so that the stopper 12 is inhibited from moving rearward in the article rack 4 together with the base plate 11 and left at a position reached when the base plate 11 reached the dispensing position, independently of the movement of the base plate 11 toward the holding position. The base plate 11 returns to the holding position through counterclockwise rotation of the first pinion gear P1.

Further, when articles S are loaded into the article rack 4, for instance, it is possible to move the stopper 12 to an extreme rearward position on the article passage 4*f* while pushing the knob 12*e* of the lever 12*d* rearward by a finger. More specifically, when the knob 12*e* is pushed rearward by the finger, the lever 12*d* rotates clockwise to disengage the claw 12*f* formed at the front end thereof from the first pinion gear P1, whereby the first pinion gear P1 is allowed to rotate about the rotational shaft 12*b*. At the same time, the lever 12*d* causes the linkage, not shown, to move the third pinion gear P3 leftward along the rotational shaft 12*b*.

This lateral motion of the third pinion gear P3 causes disengagement of the gear P3 from the left end of the rotational shaft 12*b*, whereby the gear P3 is allowed to freely rotate independently of the rotational shaft 12*b*. When the stopper 12 is pushed rearward in a state in which the first and third pinion gears P1 and P3 are allowed to freely rotate relative to the rotational shaft 12*b* independently of the same, the gears P1 and P3 perform clockwise rotation in meshing engagement with the respective first and third rack gears R1 and R3, and at the same time the second pinion gear P2 performs counterclockwise rotation in unison with the rotational shaft 12*b*, in meshing engagement with the second rack gear R2, which enables the stopper 12 to move back to the extreme rearward position on the article passage 4*f*.

The gate 13 is a transparent bar formed of a synthetic resin and mounted at a front end of a rotational shaft 13*a* as shown in FIG. 4. The gate 13 opens and closes the dispensing opening 4*g* by rotation of the rotational shaft 13*a* (see FIGS. 8A to 8C). The rotational shaft 13*a* is arranged on a front portion of an outer surface of the side wall 4*a* in a manner extending in the front-rear direction. As shown in FIG. 8B, the rotational shaft 13*a* pivotally moves in a manner interlocked with the movement of the base plate 11 toward the dispensing position for vending the article S, to thereby cause the gate 13 to withdraw upward and open the dispensing opening 4*g*.

As shown in FIGS. 6 and 10, the article-dispensing mechanism 10 further includes a slide plate 14 slidably mounted on an underside surface of the bottom wall 4*b* of the article rack 4, a double gear 15 rotatably mounted on the underside surface of the bottom wall 4*b*, and a coiled spring 16 for connecting between the slide plate 14 and the base plate 11. As shown in FIGS. 8A to 8C and 13, the slide plate 14 is arranged in a manner movable in the front-rear direction and has a rearward half portion thereof formed with a fourth rack gear R4. The double gear 15 is comprised of an upper large-diameter gear 15*a* and a lower small-diameter gear 15*b* integrally formed with the large-diameter gear 15*a*. The large-diameter gear 15*a* is in constant mesh with the fourth rack gear R4 of the slide plate 14.

The small-diameter gear 15*b* is arranged such that it can mesh with a sector gear 36, described hereinafter, included in the drive mechanism 20. When the small-diameter gear 15*b* is brought into meshing engagement with the sector gear 36, the gear 15*b* performs clockwise and counterclockwise rotations, or normal and reverse rotations, through a predetermined angle. When the double gear 15 performs the normal and reverse rotations through the predetermined angle, the mesh between the fourth rack gear R4 and the large-diameter gear 15*a* causes the slide plate 14 to move in the front-rear direction by a stroke L1 (see FIG. 8). That is, the slide plate 14 moves forward in accordance with clockwise rotation of the double gear 15, and moves rearward in accordance with counterclockwise rotation of the same.

As shown in FIG. 6, the slide plate 14 is formed with a projection 14*b* projecting leftward from a central portion thereof, and in a rear portion of the bottom wall 4*b* of the article rack 4, there is formed a projection 4*t* which is formed by bending a portion cut out from the bottom wall 4*b*. When the slide plate 14 moves rearward, the projection 14*b* is brought into abutment with the projection 4*t*, whereby the slide plate 14 is inhibited from moving further. This construction makes it possible to prevent the slide plate 14 from moving rearward further than required in accordance with counterclockwise rotation of the double gear 15 which would continue due to an inertial force even after the double gear 15 is released from the meshing engagement with the sector gear 36. A hook 14*a* is formed at a forward end of the slide plate 14, while a hook 11*b* is formed in a rearward portion of the base plate 11 by bending a portion cut from the base plate 11 such that it projects downward.

The coiled spring 16 has one end thereof attached to the hook 14*a* and the other end thereof attached to the hook 11*b* for connecting between the slide plate 14 and the base plate 11. The connection by the coiled spring 16 enables the base plate 11 to move between the dispensing position and the holding position in a manner interlocked with the movement of the slide plate 14 in the front-rear direction. In this case, in order to dispense an article S reliably by the article-dispensing mechanism 10, it is required that the base plate 11 perform positive reciprocating motion in the front-rear direction by the maximum stroke L2max. Therefore, the stroke L1 (see FIGS. 8A to 8C and 13) of the slide plate 14 is set to a value which is equal to or larger than the maximum stroke L2max ($L1 \geqq L2max$). The right-hand article-dispensing mechanism 10 is constructed as above, and the construction of the left-hand article-dispensing mechanism 10 is similar to that of the right-hand article-dispensing mechanism 10.

Figure 11:
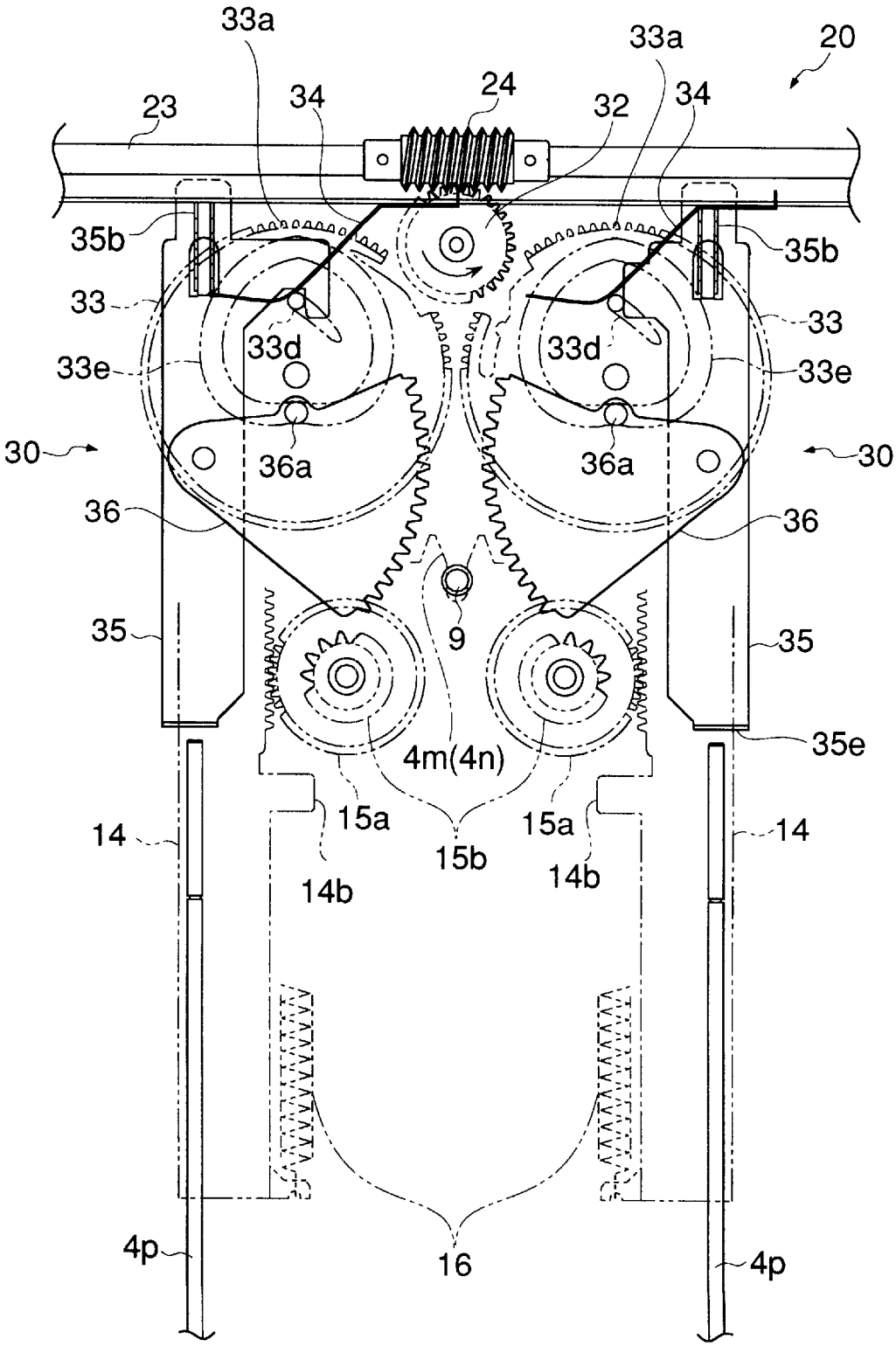
FIG. 11 is a plan view showing the construction of linkages.
Figure 12:
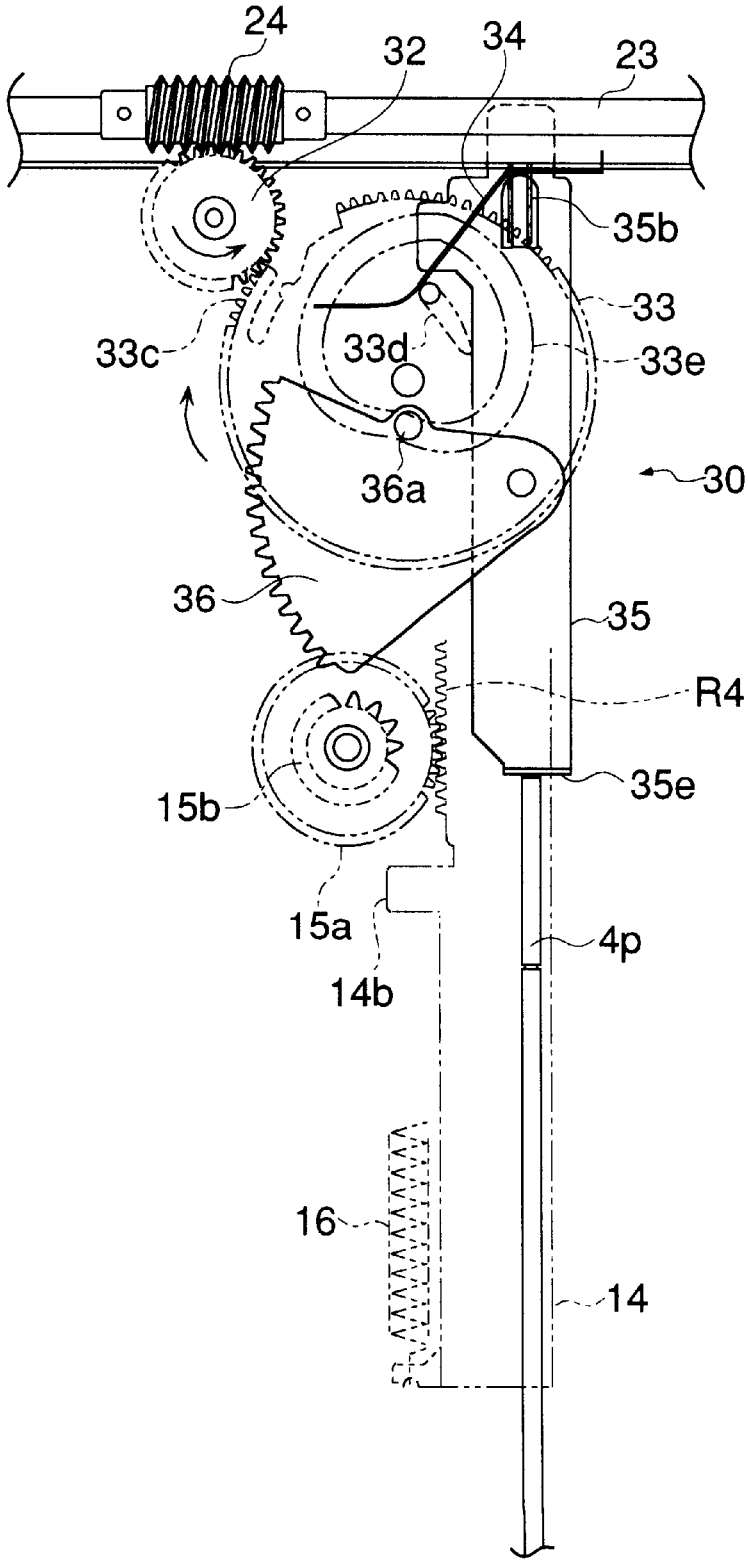
FIG. 12 is a plan view showing the linkage in a state of one of second gears being rotated clockwise to a second rotational angle position at which the second gear is brought into meshing engagement with a first gear.

As shown in FIG. 9A, the article rack 4 has two pairs of front and rear rollers 4r provided on respective left and right-side ends of the bottom wall 4b (only two rollers 4r are shown in FIG. 9A). The article rack 4 is placed on the shelf 6 via the rollers 4r in a manner movable in the front-rear direction. Accordingly, the article rack 4 normally received in a received position in the storage box 5 as shown in FIG. 9A can be drawn forward out of the storage box 5, as shown in FIG. 9B, e.g. for loading. As shown in FIGS. 9B and 11, on a rear end portion of the underside surface of the bottom wall 4b, there is arranged a positioning plate 4m formed with a cutout 4n at a portion central in the left-right direction as viewed in FIG. 11, and on the shelf 6, a pin 9 is mounted in a manner protruding upward for being fitted in the cutout 4n.

The pin 9 is arranged such that it is fitted in the cutout 4n of the positioning plate 4m when the article rack 4 is held in the received position. When the article rack 4 is returned into the storage box 5 e.g. after loading, the pin 9 is fitted in the cutout 4n, thereby positioning the rack 4 longitudinally and laterally at the predetermined received position on the shelf 6. Further, arranged on a front end portion of the bottom wall 4b is a locking device, not shown, for locking the article rack 4 at the received position on the shelf 6. Before the article rack 4 is drawn out as shown in FIG. 9B, the locking device is operated to unlock the article rack 4 from the shelf 6.

As shown in FIGS. 6 and 9A, 9B, the pair of left and right push rods 4p, 4p are mounted at respective locations below the bottom wall 4b of the article rack 4 in a manner movable in the front-rear direction. The push rods 4p, 4p extend in the front-rear direction in parallel with respective left and right side ends of the bottom wall 4b. A forward end of each of the push rods 4p projects forward through a hole formed through a lower jaw portion of a front face of the article rack 4. A rearward end of the push rod 4p extends to the vicinity of a trigger plate 35, described hereinafter, of the drive mechanism 20 arranged on a portion of the shelf 6 close to a rear end of the article rack 4 (see FIG. 11).

As shown in FIGS. 8A to 8C, the elevator 8 is arranged at a location forward of the article racks 4 such that it can move vertically and horizontally between the dispensing opening 4g of each of the article racks 4 and the take-out opening 3c. The elevator 8 moves to the vicinity of the dispensing opening 4g of an article rack 4 storing an article S selected by the purchaser to stop thereat, and receives the article S dispensed from the dispensing opening 4g, followed by carrying the article S to the take-out opening 3c for vending. The elevator 8 is L-shaped in cross section, and has a guide wall 8a which can be pivotally tilted rearward through a predetermined angle. The elevator 8 normally located forward of the dispensing opening 4g can receive an article S positively from the dispensing opening 4g when the guide wall 8a is pivotally tilted rearward. Further, the elevator 8 includes the solenoid mechanism, not shown, for urging the push rod 4p rearward when the elevator 8 stops in the vicinity of the dispensing opening 4g. The solenoid mechanism can also urge the left and right push rods 4p, 4p of one article rack 4 simultaneously as required.

As shown in FIGS. 3, 9A, 9B, 10 and 11, arranged in the vicinity of the rear wall 6b of the shelf 6 is the drive mechanism 20 for driving the article-dispensing mechanism 10. The drive mechanism 20 is comprised of the motor 21 serving as a drive source, a reduction gear mechanism 22 (see FIG. 3), the drive shaft 23, and the linkage 30. The motor 21 is arranged at a right-hand corner behind the rear wall 6b and connected to the drive shaft 23 via the reduction gear mechanism 22. The motor 21 rotates in one direction during operation of the vending machine for vending an article S. The reduction gear mechanism 22 is a train of a plurality of gears, not shown. The reduction gear mechanism 22 reduces rotational speed of the motor 21 and transmits the torque to the drive shaft 23 to thereby cause the drive shaft 23 to rotate counterclockwise as viewed in FIG. 10 (in a direction indicated by an arrow in the figure). The drive shaft 23 is arranged between the rear wall 5b of the storage box 5 and the rear wall 6b of the shelf 6 in a manner extending in the left-right direction. The drive shaft 23 is rotatably supported by bearings, not shown. Further, the drive shaft 23 has four worms 24 fitted thereon. The four worms 24 are disposed at respective locations corresponding to the four article racks 4 placed on a corresponding one of the shelves 6. The torque of the drive shaft 23 is transmitted via each of the worms 24 to the pair of left and right linkages 30, 30, described in detail hereinafter, of a corresponding one of the article racks 4.

As shown in FIGS. 3 and 10, arranged on the shelf 6 are four pairs of the left and right linkages 30, 30 each corresponding to the left and right article-dispensing mechanisms 10, 10 provided for each of the article racks 4. The left and right linkages 30, 30 are constructed similarly to each other with the exception of a few component parts and elements, as shown in FIG. 11, so that the following description is made of the construction or arrangement of the right-hand linkage 30 alone. The differences between the left and right linkages 30, 30 will be described thereafter. The linkage 30 which operates to transmit torque from the worm 24 to the article-dispensing mechanism 10 includes a gear mechanism 31 connected to the worm 24. The gear mechanism 31 is comprised of a first gear 32, and a second gear 33 which can mesh with the first gear 32.

The first gear 32 is a worm wheel arranged on the shelf 6 such that it can rotate about a vertical axis thereof in mesh with the worm 24. The first gear 32 rotates counterclockwise as viewed e.g. in FIG. 11 (in a direction indicated by an arrow in the figure) in accordance with rotation of the worm 24. Similarly to the first gear 32, the second gear 33 is arranged on the shelf 6 such that it can rotate about a vertical axis thereof. The second gear 33 has gear teeth 33a formed on an outer peripheral surface thereof such that the gear teeth 33a can mesh with the first gear 32, a cut-away portion 33b formed by cutting away a portion of the gear teeth such that the portion cannot engage with the first gear 32, and an arm portion 33c formed by cutting away a portion located radially slightly inward of the outer peripheral surface formed with the tooth gear 33a and extending circumferentially from one side face of the cut-away portion 33b.

As shown in FIGS. 10 and 11, the second gear 33 has a projection 33d formed on an underside surface thereof in a manner projecting downward. The projection 33d is held between a leaf spring 34 serving as driving means for driving the second gear 33 and the trigger plate 35. The leaf spring 34 has a rear end thereof fixed to the rear wall 6b of the shelf 6, and a front end thereof in constant contact with the projection 33d for urging the second gear 33 in a clockwise direction as viewed e.g. in FIG. 12 (in a direction indicated by an arrow in the figure). The trigger plate 35 extends in the front-rear direction between the vicinity of the rearward end of the push rod 4p on the shelf 6 and the rear wall 6b of the shelf 6. The trigger plate 35 has a rearward portion thereof formed with a rear projection 35a in contact with the projection 33d of the second gear 33. Further, the trigger plate 35 is constantly urged forward by a coiled spring 35*b* for restoring its standby position. The trigger plate 35 is formed with a slot 35*c* in a forward portion thereof. A pin 35*d* erected on the shelf 6 is engaged with the slot 35*c*. The trigger plate 35 has a contact portion 35*e* formed by bending a forward end thereof vertically upward.

The trigger plate 35 is arranged such that it can move in the front-rear direction between an engagement position (position shown in FIG. 11) in which a rear edge of the slot 35*c* is brought into contact with the pin 35*d* and a triggering position (position shown in FIGS. 10 and 12) in which a front edge of the slot 35*c* is brought into contact with the pin 35*d*. An inner or center-side edge of the rear projection 35*a* of the trigger plate 35 is engaged with the projection 33*d* of the second gear 33 when the trigger plate 35 is in the engagement position, and disengaged from the same when the trigger plate 35 is in the triggering position. Normally, the trigger plate 35 is held in the engagement position by the urging force of the coiled spring 35*d*, with the rear projection 35*a* in engagement with the projection 33*d* of the second gear 33, to thereby keep the second gear 33 from rotating clockwise, against the urging force of the leaf spring 34. In this state of the second gear 33, the cut-away portion 33*b* is opposed to the first gear 32 and held in a first rotational angle position (angle position shown in FIG. 11) in which the second gear 33 is inhibited from engaging with the first gear 32. On the other hand, during vending operation of the vending machine, the push rod 4*p* is urged rearward by the solenoid mechanism of the elevator 8, whereby the rearward end of the push rod 4*p* is brought into abutment or contact with the contact portion 35*e* of the trigger plate 35 (see FIG. 12). This shifts the trigger plate 35 from the engagement position to the triggering position.

Figure 13:
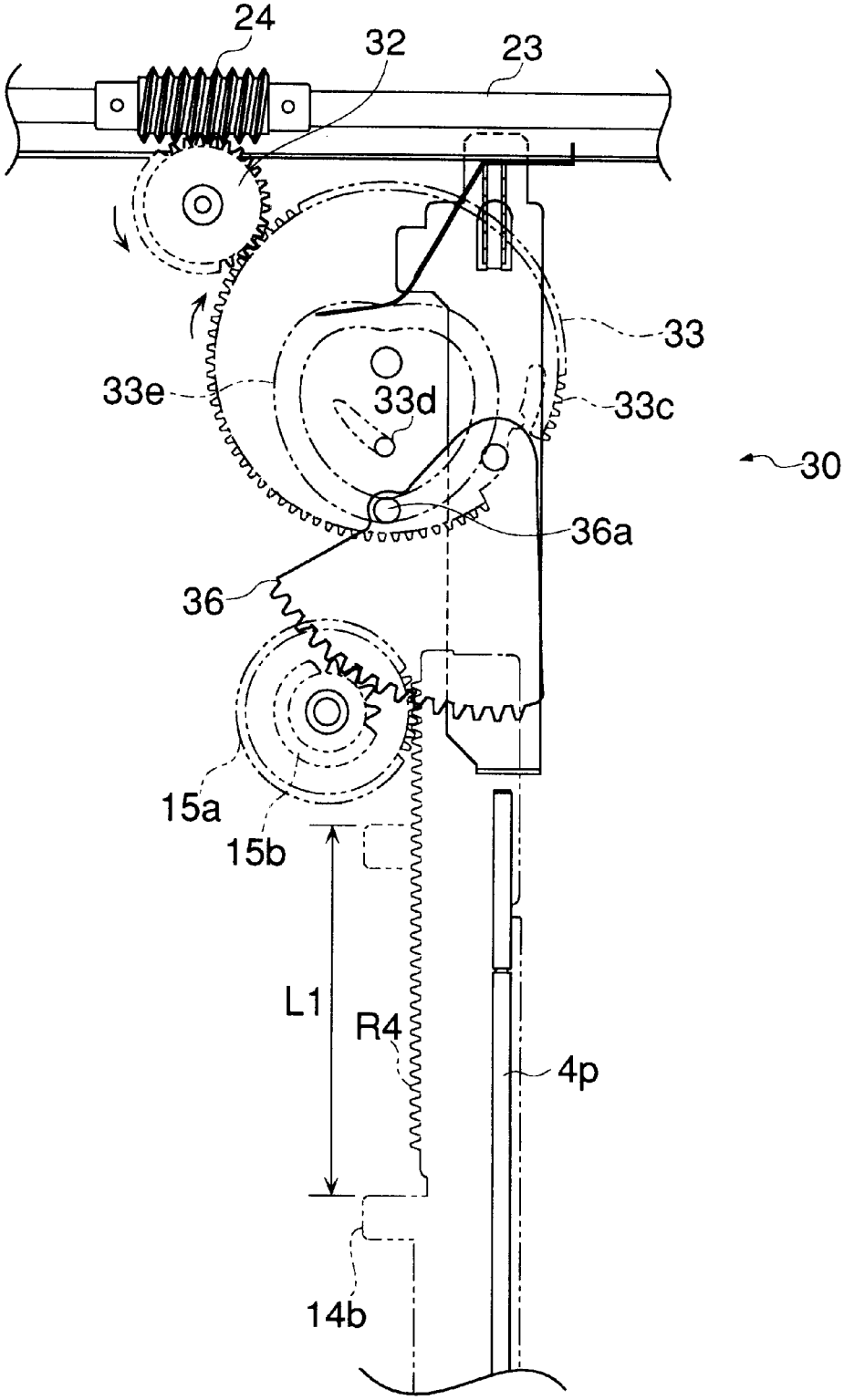
FIG. 13 is a plan view showing a slide plate of the article-dispensing mechanism in a state in which the slide plate has moved forward over a stroke L1 in accordance with further clockwise rotation of the second gear from the FIG. 12 state.
Figure 14:
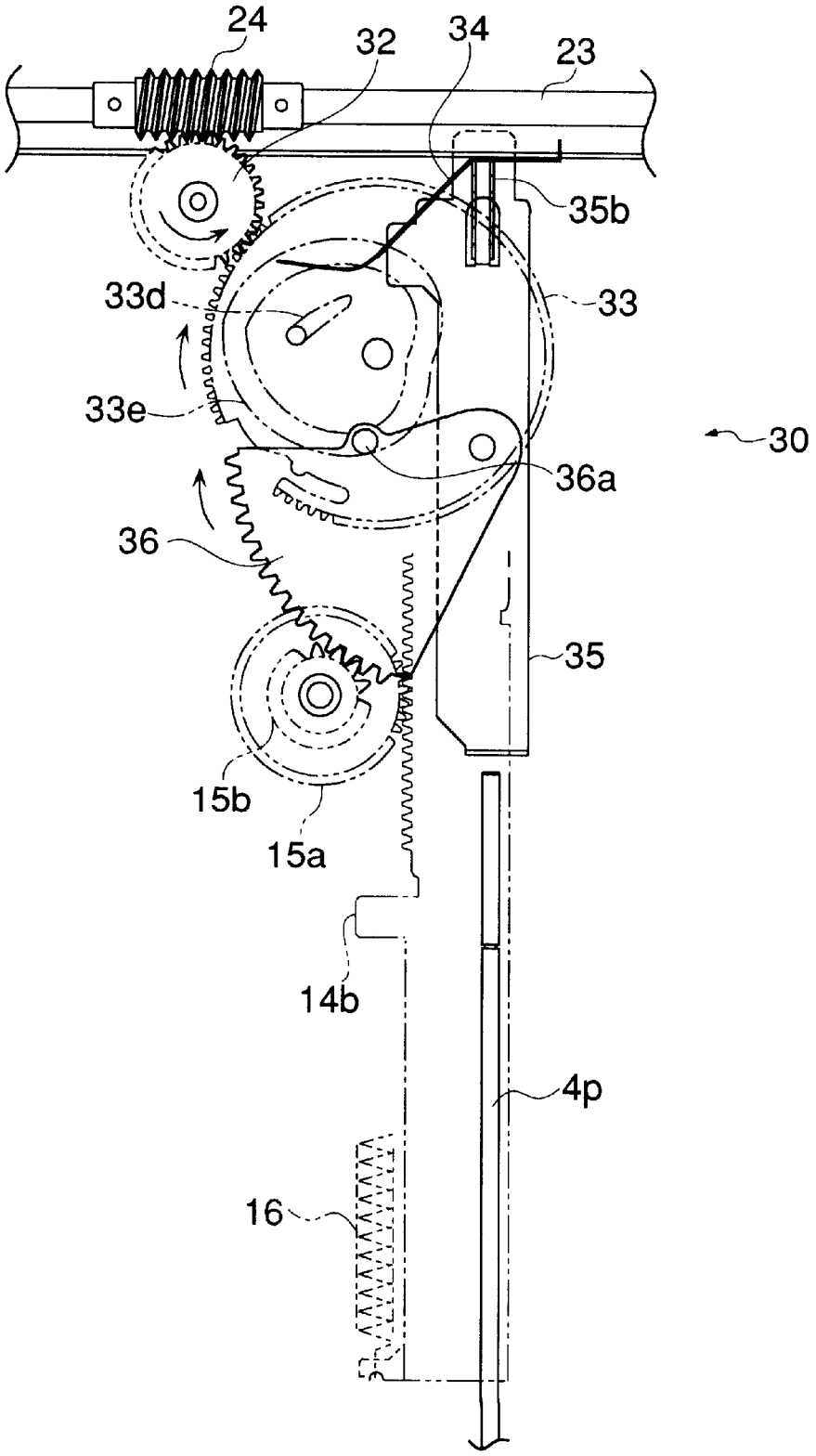
FIG. 14 is a plan view showing the linkage in a state in which the second gear is further rotated clockwise from the FIG. 13 state.

When the trigger plate 35 moves to the triggering position, the center-side edge of the rear projection 35*a* is disengaged from the projection 33*d* of the second gear 33, so that the urging force of the leaf spring 34 causes the second gear 33 to rotate clockwise from the first rotational angle position to a second rotational angle position (angle position shown in FIG. 12) in which the gear teeth 33*a* of the arm portion 33*c* are brought into meshing engagement with the first gear 32. The arm portion 33*c* is elastically deformable such that it can be slightly bent toward the center of the second gear 33, so that even if the gear teeth 33*a* are slightly offset with respect to gear teeth of the first gear 32, the former can be positively meshed with the latter by elastic deformation. After having meshed with the first gear 32, the second gear 33 is caused to perform one clockwise rotation by torque of the first gear 32 as shown in FIGS. 13 and 14. Then, after the rotation, the projection 33*d* of the second gear 33 is held again between the leaf spring 34 and the trigger plate 35 as shown in FIG. 11, whereby the second gear 33 returns to the first rotational angle position.

Further, on the underside surface of the second gear 33, there is formed a heart-shaped engaging groove 33*e*. The sector gear (reciprocating member) 36 is arranged under the second gear 33 in a pivotally movable manner, and an engaging pin 36*a* is erected on a top surface of the sector gear 36. The sector gear 36 is mounted on the shelf 6 such that the engaging pin 36*a* slides within and along the engaging groove 33*e*. As shown in FIGS. 11 to 14, the sector gear 36 is guided by the engaging groove 33*e* to rotate counterclockwise through a predetermined angle and then rotate reversely or clockwise through the predetermined angle, in accordance with the one rotation of the second gear 33.

In the normal and reverse rotations, the sector gear 36 is brought into meshing engagement with the small-diameter gear 15*b* of the double gear 15 described hereinbefore, to cause the same to rotate clockwise through a predetermined angle and then rotate reversely or counterclockwise through the predetermined angle. As described hereinabove, when the double gear 15 performs the normal and reverse rotations through the predetermined angle, the slide plate 14 reciprocates in the front-rear direction over the stroke L1, thereby causing the base plate 11 to reciprocate in the front-rear direction over the stroke L2.

Next, description will be made of differences in construction between the right-hand linkage 30 constructed as above and the left-hand linkage 30. The left and right linkages 30, 30 are constructed symmetrically with respect to the center line of the article rack 4 with the exception of the second gear 33, the trigger plate 35, and the leaf spring 34. The differences in construction result from the fact that the second gears 33, 33 of the left and right linkages 30, 30 rotate in the same direction in mesh with the identical first gear 32. More specifically, in the left-hand linkage 30, as shown in FIGS. 10 and 11, the cut-away portion 33*b* of the second gear 33 is different in shape from that of the right-hand second gear 33, and the projection 33*d* of the same is formed asymmetrically to that of the right-hand second gear 33. That is, the two projections 33*d* extend obliquely in the same direction. Further, the left-hand leaf spring 34 is also arranged in a manner extending obliquely in the same direction as the right-hand one 34 does, and the rear projection 35*a* of the trigger plate 35 has an inverted L-shape in plan view such that it is engaged with the projection 33*d* in a manner embracing the same from outside. The projection 33*d* is held between the leaf spring 34 and the rear projection 35*a* similarly to the right-hand projection 33*d*. The left-hand linkage 30 constructed as above operates similarly to the right-hand linkage 30, so that detailed description thereof is omitted.

Next, the operation of the article storage dispensing/device 1 constructed as above will be described in detail. The description is made of a case in which an article S stored in the right-hand article passage 4*f* of an article rack 4 is selected and vended. When the buttons or keys of the product selection keypad 3*e* are pushed by a purchaser for selection of the article S, the motor 21 of the drive mechanism 20 is started to cause the drive shaft 23 to rotate clockwise as viewed in FIG. 10 via the reduction gear mechanism 22, whereby the first gear 32 of the linkage 30 in mesh with the worm 24 fitted on the drive shaft 23 performs counterclockwise rotation as shown in FIG. 11. At the start of this vending operation, since the projection 33*d* of the second gear 33 of the linkage 30 is held between the leaf spring 34 and the rear projection 35*a* of the trigger plate 35, the second gear 33 is held in the first rotational angle position in which the second gear 33 is inhibited from meshing with the first gear 32.

As the motor 21 rotates, the elevator 8 moves to the vicinity of the dispensing opening 4*g* of the article passage 4*f* storing the selected article S and stops thereat, as shown in FIG. 8A. Then, as shown in FIG. 8B, the guide wall 8*a* of the elevator 8 is pivotally tilted rearward, and at the same time, the gate 14 opens the dispensing opening 4*g*. Further, the solenoid mechanism of the elevator 8 is excited to push the push rod 4*p* rearward, whereby the linkage 30 of the article passage 4*f* is switched from the disconnected state to the connected state. More specifically, the rearward end of the push rod 4*p* is brought into abutment or contact with the contact portion 35*e* of the trigger plate 35 of the linkage 30, to move the trigger plate 35 to the triggering position against the urging force of the coiled spring 35*b* (see FIG. 12). This motion of the trigger plate 35 disengages the rear projection 35*a* from the projection 33*d*, as a result of which the projection 33*d* is urged rightward by the urging force of the leaf spring 34, whereby the second gear 33 is rotated clockwise to the second rotational angle position for meshing engagement between the arm portion 33*c* and the first gear 32 (see FIG. 12). The second gear 33 in mesh with the first gear 32 performs one clockwise rotation and then returns to the first rotational angle position. During this rotation of the second gear 33, the engaging pin 36*a* of the sector gear 36 slides within and along the engaging groove 33*e* in a manner guided by the same. This causes the sector gear 36 to perform normal and reverse rotations between the rotational angle position shown in FIG. 11 and that shown in FIG. 13, to thereby cause the slide plate 11 to reciprocate in the front-rear direction between the holding position and the dispensing position.

More specifically, when the sector gear 36 performs counterclockwise rotation between the rotational angle position shown in FIG. 11 and that shown in FIG. 13, the small-diameter gear 15*b* of the double gear 15, with which the sector gear 36 is brought into meshing engagement, rotates to move the slide plate 11 in mesh with the large-diameter gear 15*a* of the double gear 15 forward over the stroke L1. The base plate 11 connected to the slide plate 14 by the coiled spring 16 also moves forward by the stroke L2 in accordance with the forward movement of the slide plate 14, until the base plate 11 abuts against the base plate stopper 7 to stop at the dispensing position. During the forward movement of the base plate 11, the first pinion gear P1 in mesh with the first rack gear R1 is inhibited from rotating, so that the stopper 12 is held on the base plate 11 and moves together with the same. The articles S on the base plate 11 move together with the base plate 11 with their attitudes held by the stopper 12. Therefore, in the dispensing position, a foremost selected article Sx of all the articles S stored in the article passage 4*f* is projected forward from the dispensing opening 4*g* of the article rack 4 by the stroke L2 of the base plate 11.

Thereafter, when the sector gear 36 performs reverse rotation in the clockwise direction from the rotational angle position shown in FIG. 13 through that shown in FIG. 14 to that shown in FIG. 11, the small-diameter gear 15*b* of the double gear 15 in mesh with the sector gear 36 rotates, whereby the slide plate 14 in mesh with the large-diameter gear 15*a* of the double gear 15 moves rearward over the stroke L1 (see FIG. 8C). The base plate 11 moves rearward over the stroke L2 in accordance with the rearward movement of the slide plate 14. During the rearward movement of the base plate 11, the second and third pinion gears P2, P3 in engagement with the respective rack gears R2, R3 are inhibited from rotating, so that the stopper 12 is held by the article rack 4 at the same position which it reached for dispensing the article S, independently of the motion of the base plate 11.

Thus, when the base plate 11 returns to the holding position, the rear most one of the articles S on the base plate 11 abuts against the stopper 12, and the articles S are each held in a position where it is stopped, independently of the motion of the base plate 11. As a result, the base plate 11 moves rearward off a bottom of the selected article Sx projecting outward from the dispensing opening for vending. In this embodiment, the amount of projection of the selected article Sx from the dispensing opening 4*g* is equal to the stroke L2 which is set to a value approximately equal to the depth of the article S, so that the selected article Sx is delivered onto the elevator 8 in an attitude-fixed state, without changing its orientation (see FIG. 8C). Then, the gate 13 closes the dispensing opening 4*g*, while the selected article Sx is carried by the elevator 8 to the take-out opening 3*c* for vending. Thus, the vending operation of the article storage/dispensing device 1 is completed.

In the case of dispensing an article S1 stored in the second article rack 4 from the left in FIG. 3, i.e. a foremost one of a horizontal row of articles S1 having a large width and occupying the two base plates 11, 11 in the article rack 4 with the partition wall 4*d* removed therefrom, the left and right push rods 4*p*, 4*p* of the article rack 4 are urged simultaneously by the solenoid mechanism. As a result, the left and right article-dispensing mechanisms 10, 10 are started simultaneously to carry out the operation described above, for vending the wide article S1. Further, to vend low-priced articles S of the same kind two by two, it is only required to operate the left and right solenoid mechanisms as described above, or alternatively set the stroke L2 of the base plate 11 to a value which is twice as large as the depth of the article S to be vended.

As described above in detail, according to the article storage/dispensing device 1 of the invention, since it is possible to drive a selected one of a plurality of article dispensing mechanisms 10 by using the single motor 21 to dispense an article S from a corresponding one of the article racks 4, it is not required to provide a motor 21 for each of the article racks 4 as in the prior art, so that cost of component parts can be reduced. In addition, since wiring is required only for the single motor, the number of cables and labor required for wiring can be reduced, which contributes to reduction of manufacturing costs. Moreover, in the article storage/dispensing device 1, an article S can be dispensed not by normal and reverse rotations of the motor 21 but simply by rotation of the same in one direction, so that service life of the motor 21 is prolonged, and control of the motor 21 is facilitated. Furthermore, it is possible to dispense with limit switchs, etc. which the prior art requires for detecting an angle through which the motor rotates since the motor no longer performs normal and reverse rotations. Therefore, the manufacturing costs of the device can be further reduced.

Further, the motor 21 is connected to each of the article-dispensing mechanisms 10 via the reduction gear mechanism, the worm 24, and the gear mechanism 31 of the linkage 30. Therefore, by setting each gear ratio properly, it is possible to drive the article-dispensing mechanism 10 even when the torque of the motor 21 is small, and thereby dispense an article S reliably. Still further, the second gear 33 of the gear mechanism 31 Is formed with the arm portion 33*c* which can be elastically deformed toward the center of the second gear 33 when the second gear 33 is brought into meshing engagement with the first gear 32, which ensures positive or proper engagement between the two gears 32 and 33 even if teeth of the two gears 32 and 33 are displaced from each other. This also makes it possible to dispense the article S reliably.

Moreover, it is possible to switch the linkage 30 to the state of connecting between the motor 21 and the article-dispensing mechanism 10, simply by urging the push rod 4*p* by the solenoid mechanism of the elevator 8. Furthermore, it is possible to set an area of an urging surface of the solenoid mechanism properly such that it is large enough to actuate the push rod 8, so that the push rod 8 can be pushed positively even when a position in which the elevator 8 stops for receiving an article S is slightly offset from a normal position opposed to the article rack 4. Thus, the article S can be dispensed more reliably.

Further, the motor 21, the drive mechanism 20, and the four article racks 4 are provided on the shelf 6, and at the same time, a mounting position of the shelf 6 within the storage box 5 can be shifted vertically. Therefore, the mounting position of the shelf 6 can be shifted, without any need to adjust a positional relationship between the motor 21, the drive mechanism 20, and the four article racks 4. This facilitates an operation for changing the height of a storage space above the bottom wall of each of the article racks 4.

According to the article storage/dispensing device 1 of the invention, when the base plate 11 returns to the standby position after having moved to the dispensing position, the stopper 12 is held in engagement with the article rack 4 and released from the base plate 11, whereby a rearmost one of the articles S on the base plate 11 is brought into abutment with the stopper 12 and the articles S are inhibited from moving rearward. At this time point, the selected article Sx at the foremost position is projected forward from the dispensing opening 4*g* by the stroke L2 set to a value which is approximately equal to the depth of the article S, so that the base plate 11 moves off the bottom of the selected article Sx. As a result, differently from the prior art, the selected article Sx is delivered onto the elevator 8 in an attitude-fixed state, without changing its orientation. Therefore, even if an article S is contained in a container made of a soft material or has a shape on which an urging force cannot act evenly, it is possible to reliably dispense the article S in a stable state.

Further, the urging force for dispensing an article S acts only when the rearmost article S is brought into abutment with the stopper 12 during the dispensing operation, and the urging force is reduced with a decrease in number of the articles S as the vending proceeds, so that even an article S contained in a container made of a soft material can be stored and dispensed without being deformed or broken. Moreover, since the article S is dispensed in an attitude-fixed state reliably and stably, it is possible to use the elevator 8 having a depth (dimension in the front-rear direction) which is smaller than that of a conventional one. As a result, the depth of the vending machine is also reduced, which makes it possible to enhance storage efficiency of the machine.

Furthermore, a location at which the abutment member 7*b* of the base plate stopper 7 is mounted on the mounting plate 7*a* can be shifted to any desired one of the four predetermined locations in the front-rear direction, and hence the dispensing position of the base plate 11 determined by a position at which the projections 11*a* of the base plate 11 are brought into abutment with the base plate stopper 7 can also be selectively set to any one of four locations corresponding to the respective four mounting positions of the abutment member 7*b*. Accordingly, the stroke L2 of the base plate 11 can be selectively set to any one of the four levels of distance, which makes it possible to preset a desired one of four different strokes L2 in a manner adapted to any one of four depths of articles S to be stored, to thereby vend articles S having the four different depths reliably in a stable state.

Further, since the base plate 11 and the slide plate 14 are connected by the coiled spring 16, shock occurring when the base plate 11 abuts against the base plate stopper 7 or returns to the standby position is prevented from being transmitted to the drive mechanism 20 via the slide plate 14, which makes it possible to enhance durability of the drive mechanism 20.

Although in the above embodiment, the motor is used as a drive source, this is not limitative, but it is possible to employ any single drive source which is capable of causing rotation of the drive shaft 23. For instance, motion of a solenoid plunger may be converted into torque of the drive shaft 23. Further, as far as the elevator 8 is concerned, it is possible to provide an elevator 8 having a width which is large enough to cover the whole row of four article racks 4 on a single shelf 6 and to provide the elevator 8 with a solenoid mechanism which is capable of selectively urging one or more of the push rods 4*p* of the four article racks 4, to thereby dispense a plurality of articles S simultaneously from the different article racks 4 corresponding to the one or more pushing rods.

Further, although in the above embodiment, the base plate 11 moves horizontally, this is not limitative, but the base plate 11 may be arranged such that it moves obliquely upward and downward in its respective forward and rearward movements. Still further, articles S may be dispensed rearward from the article racks 4. Moreover, in the above embodiment, the base plate 11 is formed with the first rack gear R1, and the article rack 4 with the rack gears R2, R3, while the stopper 12 is provided with the three pinion gears P1 to P3 which can mesh with the respective rack gears R1 to R3, the rotational shaft 12*b*, the lever 12*d*, the one-way clutch CL, etc., such that the stopper 12 can be held in engagement with the base plate 11 and the article rack 4, respectively, during the forward and rearward movement of the base plate 11, but this is not limitative, either, but each of the base plate 11 and the article rack 4 may be formed with a single rack gear, and the stopper 12 with two claws which form a ratchet mechanism together with the rack gear.

Although in the above embodiment, the base plate stopper 7 is mounted on the bottom wall 4*b* of the article rack 4, this is not limitative, but the base plate stopper 7 may be mounted on the shelf 6. Further, although in the embodiment, the mounting position of the abutment member 7*b* of the base plate stopper 7 on the mounting plate 7*a* is shifted between the four predetermined locations, the predetermined locations may be increased in number according to depths of various articles S to be stored.

It is further understood by those skilled in the art that the foregoing is a preferred embodiment of the invention, and that various changes and modifications may be made without departing from the spirit and scope thereof.

What is claimed is:

1. An article storage/dispensing device for a vending machine, comprising:

a plurality of article racks each for storing a plurality of articles, each of said plurality of article racks having an article passage formed therein for storing said plurality of articles in a horizontal row, and a dispensing opening formed at one end of said article passage for dispensing said articles therefrom;

a plurality of article-dispensing mechanisms each provided for one of said plurality of article racks corresponding thereto in a manner movable between a dispensing position for dispensing said articles from said dispensing opening and a holding position for holding said articles within said article passage;

a single drive source for causing said plurality of article-dispensing mechanisms to move between said dispensing position and said holding position;

a plurality of linkages each capable of connecting said drive source to one of said plurality of article-dispensing mechanisms corresponding thereto and disconnecting said drive source from said one of said plurality of article-dispensing mechanisms, for causing said one of said plurality of article-dispensing mechanisms to move from said holding position to said dispensing position when said drive source is connected to said one of said plurality of article-dispensing mechanisms; and driving means for selectively actuating one of said plurality of linkages which corresponds to an article selected by a purchaser, thereby connecting said drive source to one of said plurality of article-dispensing mechanisms which corresponds to said article selected by said purchaser, for vending said article selected by said purchaser.

2. An article storage/dispensing device according to claim 1, wherein said drive source is a motor.

3. An article storage/dispensing device according to claim 2, wherein said motor is allowed to rotate in one direction, said plurality of linkages each including a reciprocating member which can be connected to or disconnected from said motor, said reciprocating member being driven for reciprocating motion interlocked with rotation of said motor when said reciprocating member is connected to said motor, thereby causing said one of said plurality of article-dispensing mechanisms which corresponds to said article selected by said purchaser to reciprocate between said holding position and said dispensing position, and said driving means connecting said reciprocating member of said one of said plurality of linkages which corresponds to said article selected by said purchaser to said motor, for vending said article selected by said purchaser.

4. An article storage/dispensing device according to claim 3, wherein each of said plurality of linkages further includes a gear mechanism, said gear mechanism comprising a first gear driven by said motor for rotation, and a second gear formed with gear teeth which can mesh with said first gear, and a cut-away portion formed by cutting away a portion of said gear teeth for inhibiting said second gear from engaging with said first gear via said cut-away portion, said reciprocating member being connected to said second gear such that said reciprocating member performs one cycle of reciprocating motion in accordance with one rotation of said second gear, and said driving means including second gear-driving means for normally positioning said second gear at a rotational angle position in which said cut-away portion is opposed to said first gear, and causing said second gear of said gear mechanism of said one of said plurality of linkages which corresponds to said article selected by said purchaser to rotate to a rotational angle position in which said gear teeth of said second gear are brought into meshing engagement with said first gear, for vending said article selected by said purchaser.

5. An article storage/dispensing device according to any one of claims 1 to 4, further comprising an elevator arranged within a body of said vending machine at a location outward of said one end of said article passage of each of said plurality of article racks in a manner movable upward and downward, for stopping in a stop position close to said dispensing opening to receive said article selected by said purchaser, said driving means comprising a plurality of push rods provided in a manner corresponding to said plurality of article-dispensing mechanisms, respectively, and each extending in a front-rear direction between a vicinity of said dispensing opening and a vicinity of a corresponding one of said plurality of linkages, and urging means arranged in said elevator for urging one end of one of said plurality of push rods which corresponds to said article selected by said purchaser in said front-rear direction toward said corresponding one of said plurality of linkages when said elevator stops in said stop position, said corresponding one of said plurality of linkages being driven by engagement with another end of said one of said plurality of push rods which corresponds to said article selected by said purchaser, for connecting said drive source to said one of said plurality of article-dispensing mechanisms which corresponds to said article selected by said purchaser.

6. An article storage/dispensing device according to any one of claims 1 to 4, further comprising a shelf having said drive source and said plurality of linkages provided therefor, and said plurality of article racks placed thereon, wherein a plurality of mounting portions are arranged vertically within a body of said vending machine which accommodates said plurality of article racks, so as to allow said shelf to be selectively mounted to one of said plurality of mounting portions.

7. An article storage/dispensing device for a vending machine, comprising:

an article rack having two side walls opposed to each other, and a dispensing opening formed at one of front and rear ends thereof for dispensing articles therefrom;

a base plate arranged on a bottom of said article rack such that said base plate forms an article passage for storing a plurality of articles in a row extending in a front-rear direction, together with said two side walls, and such that said base plate is capable of moving in said front-rear direction relative to said article rack between a dispensing position in which said base plate is projected outward from said dispensing opening of said article rack and a standby position in which said base plate is retracted inward;

a stopper arranged on a top surface of said base plate;

first engaging means for holding said stopper in engagement with said base plate during movement of said base plate toward said dispensing position;

second engaging means for holding said stopper in engagement with said article rack during movement of said base plate toward said standby position; and a drive mechanism for holding said base plate in said standby position when said vending machine is in a standby state ready for vending said articles, and causing said base plate to move to said dispensing position, and then move back to said standby position, during operation of said vending machine for vending said articles.

8. An article storage/dispensing device according to claim 7, further comprising adjustment means for adjusting a stroke over which said base plate moves between said standby position and said dispensing position.

9. An article storage/dispensing device according to claim 8, wherein said adjustment means comprises a base plate stopper which is selectively mounted to one of a plurality of mounting positions fixed with respect to said article rack and arranged in said front-rear direction, such that said base plate is brought into abutment with said base plate stopper when said base plate has moved to said dispensing position.

10. An article storage/dispensing device according to any one of claims 7 to 9, further comprising a gate for closing said dispensing opening to thereby hold said plurality of articles between said stopper and itself when said vending machine is in said standby state ready for vending said articles, and opening said dispensing opening during said vending operation of said vending machine for vending said articles.

11. An article storage/dispensing device according to any one of claims 7 to 9, wherein said base plate is formed with a first rack gear extending in said front-rear direction, while said article rack is formed with a second rack gear extending in said front-rear direction, said first engaging means comprising a first pinion gear in meshing engagement with said first rack gear formed on said base plate, and a first blocking member for inhibiting rotation of said first pinion gear during movement of said base plate toward said dispensing position, and said second engaging means comprising a second pinion gear in meshing engagement with said second rack gear formed on said article rack, and a second blocking member for inhibiting rotation of said second pinion gear during movement of said base plate toward said standby position.

* * * * *